US008047172B2

(12) United States Patent
Nakamura et al.

(10) Patent No.: US 8,047,172 B2
(45) Date of Patent: Nov. 1, 2011

(54) PLASMA JET IGNITION PLUG

(75) Inventors: Toru Nakamura, Aichi (JP); Yuichi Yamada, Aichi (JP); Iwao Kunitomo, Kiyosu (JP); Yoshikuni Sato, Nagoya (JP); Daisuke Nakano, Hekinan (JP)

(73) Assignee: NGK Spark Plug Co., Ltd., Aichi (JP)

( * ) Notice: Subject to any disclaimer, the term of this patent is extended or adjusted under 35 U.S.C. 154(b) by 504 days.

(21) Appl. No.: 12/366,094

(22) Filed: Feb. 5, 2009

(65) Prior Publication Data

US 2009/0194053 A1 Aug. 6, 2009

(30) Foreign Application Priority Data

Feb. 6, 2008 (JP) ..... 2008-26963

(51) Int. Cl.
*F02P 21/04* (2006.01)
*F02P 23/00* (2006.01)

(52) U.S. Cl. ..... 123/143 B

(58) Field of Classification Search ..... 123/143 B
See application file for complete search history.

(56) References Cited

U.S. PATENT DOCUMENTS

| | | | | |
|---|---|---|---|---|
| 4,841,925 | A * | 6/1989 | Ward | 123/143 B |
| 7,328,677 | B2 * | 2/2008 | Hagiwara et al. | 123/143 B |
| 7,827,954 | B2 * | 11/2010 | Nagasawa et al. | 123/143 B |
| 7,959,482 | B2 * | 6/2011 | Nakamura et al. | 445/7 |
| 2007/0221156 | A1 * | 9/2007 | Hagiwara et al. | 123/143 B |
| 2007/0221157 | A1 * | 9/2007 | Hagiwara et al. | 123/143 B |

FOREIGN PATENT DOCUMENTS

| | | |
|---|---|---|
| JP | 55-166092 U | 11/1980 |
| JP | 2006-294257 | 10/2002 |

* cited by examiner

*Primary Examiner* — Erick Solis
(74) *Attorney, Agent, or Firm* — Kusner & Jaffe

(57) ABSTRACT

A plasma jet ignition plug capable of inhibiting occurrence of channeling while reducing removal of energy of plasma through a ground electrode at the time of emission of plasma. A ground electrode of a plasma jet ignition plug projects inward from a front end face of a metallic shell toward an opening end of a cavity which is open at a front end face of an insulator. A projecting distal end which forms a spark discharge gap between the same and a center electrode within a cavity is located inward, with respect to a diametral direction P orthogonal to an axis O, of a position which is located 0.5 mm radially outward from the opening end of the cavity.

17 Claims, 16 Drawing Sheets

PLASMA JET IGNITION PLUG

FIELD OF THE INVENTION

The present invention relates to a plasma jet ignition plug for generating plasma and igniting an air-fuel mixture in an internal combustion engine.

BACKGROUND OF THE INVENTION

Conventionally, an internal combustion engine; for example, an automobile engine, uses an ignition plug for igniting an air-fuel mixture by means of spark discharge (which may be referred to merely as "discharge"). In recent years, high output and low fuel consumption have been required of internal combustion engines. To fulfill such requirements, use of a plasma jet ignition plug is known, since the plasma jet ignition plug provides quick propagation of combustion and exhibits such a high ignition performance as to be capable of reliably igniting even a lean air-fuel mixture having a higher ignition-limit air-fuel ratio.

Such a plasma jet ignition plug has a structure in which an insulator (housing) formed of ceramics or the like surrounds a spark discharge gap between a center electrode and a ground electrode (external electrode), thereby forming a small-volume discharge space called a cavity (chamber). Taking as an example a plasma jet ignition plug which uses a superposition-type power source, in igniting an air-fuel mixture, a high voltage is first applied between the center electrode and the ground electrode so as to perform spark discharge. By virtue of associated occurrence of dielectric breakdown, current can flow therebetween at a relatively low voltage. Thus, through transition of a discharge state effected by a further supply of energy, plasma is generated within the cavity. The generated plasma is emitted through a communication hole (external-electrode hole) which is formed through the ground electrode, thereby igniting the air-fuel mixture (for example, see Japanese Patent Application Laid-Open (kokai) No. 2006-294257, hereinafter referred to as Patent Document 1).

According to Patent Document 1, a ground electrode is formed integrally with a metallic shell which has threads for mounting the plasma jet ignition plug to an engine. However, according to another disclosure, a ground electrode having a communication hole and a metallic shell are formed as separate members (for example, see Japanese Patent Application Laid-Open (kokai) No. 2007-287665, hereinafter referred to as Patent Document 2).

Meanwhile, in order to ensure resistance to spark-induced erosion of the ground electrode, which performs spark discharge, the ground electrode has high thermal conductivity and has such a structure as to readily release heat to the engine through the metallic shell. If plasma emitted from the cavity comes into contact with the wall surface of the communication hole of such a ground electrode, heat is transferred from the plasma to the ground electrode, so that energy of the plasma is apt to be removed. In the plasma jet ignition plugs described in Patent Documents 1 and 2, there is not much difference in diameter between the communication hole and the cavity. Thus, in emission of plasma, the plasma is apt to come into contact with the ground electrode. In order to reduce loss of energy caused by contact between plasma and the ground electrode, expansion of the opening diameter of the communication hole is preferred for rendering an emitted plasma unlikely to contact the ground electrode (for example, see Japanese Patent Application Laid-Open (kokai) No. 2007-287666, hereinafter referred to as Patent Document 3).

In the plasma jet ignition plugs described in Patent Documents 1 to 3, plasma is emitted through the communication hole of the ground electrode, and the ground electrode is formed annularly. If the ground electrode assumes a form employed in general spark plugs (e.g., the form of a bar), the volume of a portion of the ground electrode which comes into contact with plasma emitted from the cavity can be reduced, whereby loss of energy of plasma can be inhibited (for example, see Japanese Patent Application Laid-Open (kokai) No. 2000-331771, hereinafter referred to as Patent Document 4).

Problems to be Solved by the Invention

However, as in the case of Patent Document 3, the greater the opening diameter of the communication hole of the ground electrode, the more likely the front end face of an insulator is to be located on a path of spark discharge between a center electrode and the ground electrode. Accordingly, spark discharge creeps on the front end face of the insulator; i.e., spark discharge is performed in the form of so-called creeping discharge. The creeping discharge is apt to erode a portion of the surface of the insulator located on the path of spark discharge; i.e., so-called channeling is apt to arise. At this time, the path of spark discharge extends from the front end face of the insulator, passes an opening end of the cavity, and extends toward the center electrode located within the cavity. Thus, an edge portion of the opening end is apt to be eroded. Accordingly, a path of spark discharge which passes through the eroded portion becomes shorter in distance than other paths. Therefore, creeping discharge becomes more likely to arise along the path of spark discharge, resulting in a risk of local channeling progressing.

According to Patent Document 4, since the intermediate electrode provided between the center electrode and the ground electrode is electrically conductive, spark discharge arises between the ground electrode and the intermediate electrode. In this case, electric fields are apt to concentrate at an opening end, which assumes the form of a sharp edge, of the intermediate electrode. Thus, the opening end is apt to become a starting point of spark discharge. Furthermore, since the ground electrode is in the form of a bar, spark discharge concentrates at a single circumferential position on the opening end. Accordingly, the opening end of the intermediate electrode is apt to be eroded at a specific position, resulting in risk of local channeling occurring. Also, according to Patent Document 4, the distal end of the ground electrode is located in such a manner as to greatly interrupt emission of plasma; i.e., removal of heat by the ground electrode (loss of plasma energy) is not sufficiently considered.

The present invention has been achieved for solving the above-mentioned problems, and an object of the invention is to provide a plasma jet ignition plug capable of inhibiting the occurrence of channeling while reducing the removal of energy of plasma through a ground electrode at the time of plasma emission.

SUMMARY OF THE INVENTION

According to a first aspect of the present invention there is provided a plasma jet ignition plug comprising a center electrode; an insulator retaining the center electrode; a metallic shell surroundingly retaining the insulator; a cavity formed in the form of a recess in a front end of the insulator and accommodating a front end of the center electrode therein; and a ground electrode forming a spark discharge gap between the same and the center electrode via the cavity. In the plasma jet ignition plug, the ground electrode is a bar-like member joined to the metallic shell, and a distal end of the ground electrode is located radially inward of a position which is located 0.5 mm radially outward from an opening end of the cavity.

In the plasma jet ignition plug, the opening end of the cavity assumes the form of a sharp edge between its own circumferential wall surface of the cavity and the front end face of the insulator. Spark discharge performed between the center electrode accommodated within the cavity and the ground electrode follows a path which passes the sharp-edge portion. According to the first aspect of the present invention, the ground electrode is a bar-like member and is joined to the metallic shell while being positioned such that the distal end of the ground electrode is located radially inward of a position which is located 0.5 mm radially outward from the opening end of the cavity. That is, the distal end of the ground electrode is positioned relatively close to the opening end of the cavity. Accordingly, spark discharge performed between the distal end of the ground electrode and the front end of the center electrode can follow a path which extends from the center electrode to the distal end of the ground electrode while following the circumferential wall surface of the cavity without involvement of a sharp bend at the position of the opening end. That is, the path of spark discharge is unlikely to involve a segment which extends between the distal end of the ground electrode and the circumferential wall surface of the cavity and passes the opening end with such an angle as to erode the opening end. Therefore, occurrence of so-called channeling can be inhibited in which repeated spark discharge erodes the surface of the insulator, particularly the opening end, which assumes the form of a sharp edge.

Meanwhile, in emission of plasma formed within the cavity, after the plasma is emitted through the opening end, the plasma expands radially and extends in the direction of emission. If the plasma comes into contact with the ground electrode, heat is transferred from the plasma to the ground electrode, resulting in loss of energy. However, as in the case of the first aspect of the present invention, when the ground electrode is a bar-like member, loss of energy associated with contact of the plasma with the ground electrode can be inhibited to a sufficiently low level, since the volume of contact is small. Thus, such a ground electrode is preferred.

For the first aspect of the present invention it may be good practice to satisfy a relation $d/(d+w) \leqq 0.8$, where w is the length of a weld portion of the ground electrode extending along an extending direction of the ground electrode, the weld portion being formed through the ground electrode being joined to the metallic shell, and d is the length of a portion of the ground electrode extending from the weld portion toward the distal end. In joining the ground electrode and the metallic shell together, by means of setting the weld portion in such a manner as to satisfy the relation $d/(d+w) \leqq 0.8$, the strength of a joint region between the ground electrode and the metallic shell after they are joined together can be enhanced. Thus, the joint region can sufficiently endure a vibration load which might be imposed on the ground electrode in the course of use of the plasma jet ignition plug. Therefore, there is no risk of detachment of the ground electrode.

According to a second aspect of the present invention there is provided a plasma jet ignition plug comprising a center electrode; an insulator retaining the center electrode; a metallic shell surroundingly retaining the insulator; a cavity formed in the form of a recess in a front end of the insulator and accommodating a front end of the center electrode therein; and a ground electrode forming a spark discharge gap between the same and the center electrode via the cavity. In the plasma jet ignition plug, the ground electrode is a portion of the metallic shell and projects from a front end of the metallic shell, and a distal end of the ground electrode is located radially inward of a position which is located 0.5 mm radially outward from an opening end of the cavity.

Also, in the second aspect of the present invention, the distal end of the ground electrode is located radially inward of a position which is located 0.5 mm radially outward from the opening end of the cavity. Accordingly, spark discharge performed between the distal end of the ground electrode and the front end of the center electrode can follow a path which extends from the center electrode to the distal end of the ground electrode while following the circumferential wall surface of the cavity without involvement of a sharp bend at the position of the opening end. That is, the path of spark discharge is unlikely to involve a segment which extends between the distal end of the ground electrode and the circumferential wall surface of the cavity and passes the opening end with such an angle as to erode the opening end. Therefore, the occurrence of so-called channeling can be inhibited in which repeated spark discharge erodes the surface of the insulator, particularly the opening end, which assumes the form of a sharp edge.

Also, since the ground electrode is a portion of the metallic shell and projects from the front end of the metallic shell, the following advantage is yielded: as in the above-mentioned first aspect of the present invention, loss of energy associated with contact of the plasma with the ground electrode can be inhibited to a sufficiently low level, since the volume of contact is small. Furthermore, since the ground electrode is a portion of the metallic shell, strength in a boundary region between a body portion of the metallic shell and the ground electrode is high. Thus, the boundary region can sufficiently endure a vibration load which might be imposed on the ground electrode in the course of use of the plasma jet ignition plug. Therefore, there is no risk of detachment of the ground electrode.

In the first or second aspects of the present invention, the distal end of the ground electrode may be located radially inward of a position which is located 0.2 mm radially outward from the opening end of the cavity. As the distal end of the ground electrode is brought close to the front end face of the insulator, spark discharge is apt to assume the form of creeping discharge of the following path: spark discharge follows the front end face of the insulator, passes a sharp edge portion, and then reaches the circumferential wall surface of the cavity. When the distal end of the ground electrode is located radially inward of the position which is located 0.2 mm radially outward from the opening end of the cavity, the distal end of the ground electrode is brought close to the circumferential wall surface of the cavity, thereby shortening the distance of creeping discharge along the front end face of the insulator. Thus, spark discharge from the distal end of the ground electrode reaches the circumferential wall surface of the cavity before it can erode the opening end, so that occurrence of channeling can be inhibited.

In the first or second mode, the ground electrode may be in contact with the front end of the insulator. By means of bringing the ground electrode in contact with the front end of the insulator for reliably positioning the ground electrode itself in relation to the insulator, the position of the distal end of the ground electrode can be readily managed as mentioned above.

Also, in the first or second aspects of the present invention, the ground electrode may project in an inward direction. When the ground electrode assumes a simple form of, for example, bar-like projection and projects inward, the distal end of the ground electrode can be readily and reliably positioned in relation to the opening end of the cavity.

The plasma jet ignition plug according to the first or second aspects of the present invention may have a plurality of the ground electrodes. This enables a plurality of spark discharge gaps to be formed around the opening end of the cavity in a dispersed fashion. As compared with the case where only a single path of spark discharge is provided, the formation of a plurality of spark discharge gaps can inhibit erosion of the opening end caused by channeling.

In the first or second aspects of the present invention, a noble metal chip may be joined to the distal end of the ground electrode on a side toward the cavity. The ground electrode is subjected to erosion caused by spark discharge and exposure to an emitted plasma. However, when a noble metal chip having high resistance to erosion is joined to the distal end of the ground electrode which forms a spark discharge gap, resistance to erosion associated with emission of plasma can be implemented, and a portion of the ground electrode located toward the distal end can be reduced in size as well. When a portion of the ground electrode located toward the distal end is reduced in size, energy loss of the emitted plasma can be reduced, whereby ignitability can be enhanced When the noble metal chip is jointed to the distal end of the ground electrode on a side toward the cavity, spark discharge between the ground electrode and the center electrode can be performed reliably via the noble metal chip. Further, this configuration enables the noble metal chip to be disposed in such a manner as to be held between the distal end of the ground electrode and the front end of the insulator. By virtue of this, even when the noble metal chip is formed small, the noble metal chip can sufficiently maintain its state of being joined to the ground electrode, whereby detachment of the noble metal chip can be prevented.

It may be good practice for the first or second embodiment to employ the following configuration: as viewed on an imaginary plane which is orthogonal to an axial direction and on which the opening end of the cavity and the ground electrode are projected, a portion of the projected ground electrode which is located in an area enclosed by the imaginary boundary line which is concentric with an outline of the projected opening end and whose diameter is two times that of the outline, has a projected area which is 30% or less of an area enclosed by the imaginary boundary line. Further, it may be good practice to employ the following configuration: as viewed on the imaginary plane, a portion of the projected ground electrode which is located inward of the outline of the projected opening end has a projected area which is 15% or less of an area enclosed by the outline of the projected opening end.

When plasma formed within the cavity is emitted from the opening end, the plasma expands radially and extends in the direction of emission. However, in a region in which the plasma comes into contact with the distal end of the ground electrode, the energy of the plasma is removed, so that the cross section of the expanding plasma has a missing portion. When the plasma is emitted while having such a missing portion in its cross section, energy which is thrust forward drops, thereby raising the risk of deterioration in ignitability to an air-fuel mixture. Also, contact of the plasma with the ground electrode is apt to cause removal of energy from the plasma itself. Thus, as viewed on the imaginary plane which is orthogonal to the axial direction and on which the opening end of the cavity and the ground electrode are projected, a portion of the projected ground electrode which is located in an area enclosed by the imaginary boundary line in the form of a concentric circle which is concentric with an outline of the projected opening end and whose diameter is two times that of the outline, has a projected area which is 30% or less of the area enclosed by the imaginary boundary line. This can inhibit loss of energy of the plasma caused by contact with the ground electrode and drop in plasma energy which is thrust forward, whereby ignitability can be ensured.

In the case where the distal end of the ground electrode is located radially inward of the opening end of the cavity, plasma emitted from the cavity is obstructed directly by the ground electrode. In order to ensure ignitability, it may be good practice to employ the following configuration: as viewed on the imaginary plane, a portion of the projected ground electrode which is located inward of the outline of the projected opening end has a projected area which is 15% or less of an area enclosed by the outline of the projected opening end.

DETAILED DESCRIPTION OF THE INVENTION

Figure 1:
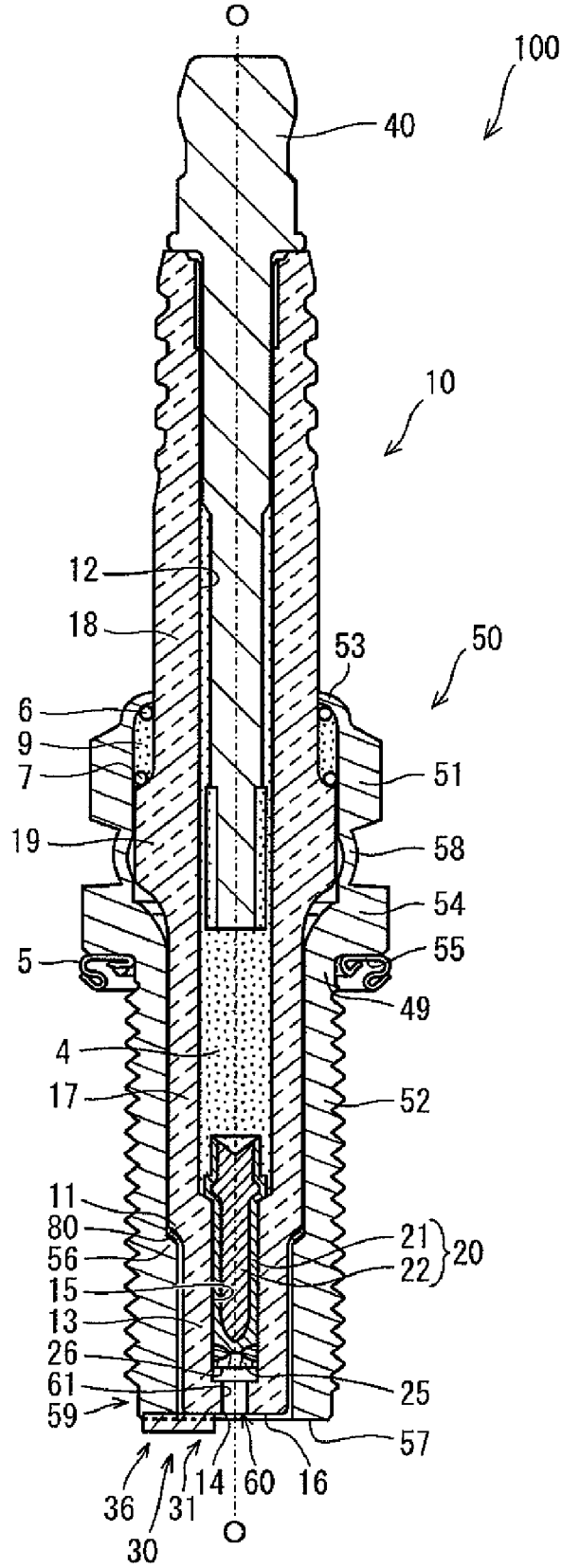
FIG. 1 is a vertical sectional view of a plasma jet ignition plug 100.
Figure 2:
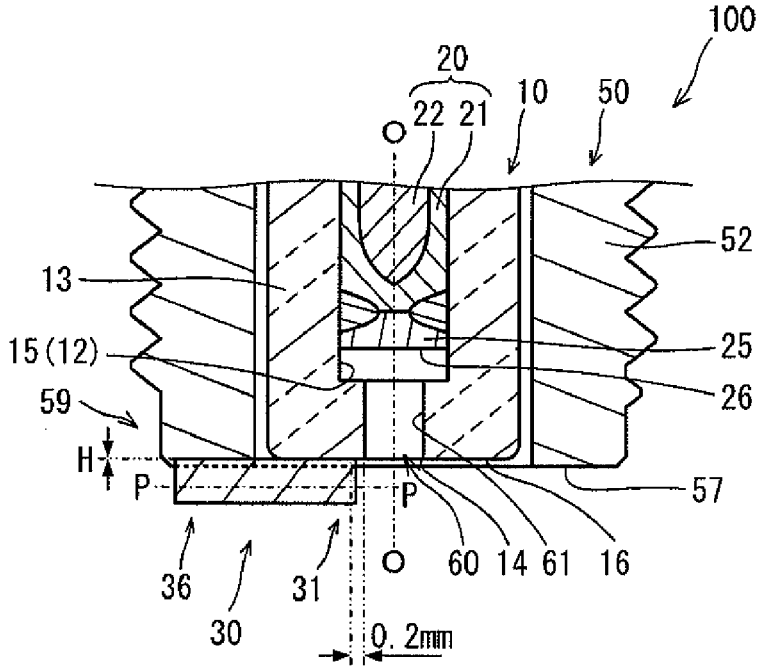
FIG. 2 is an enlarged sectional view of a front end portion of the plasma jet ignition plug 100.
Figure 3:
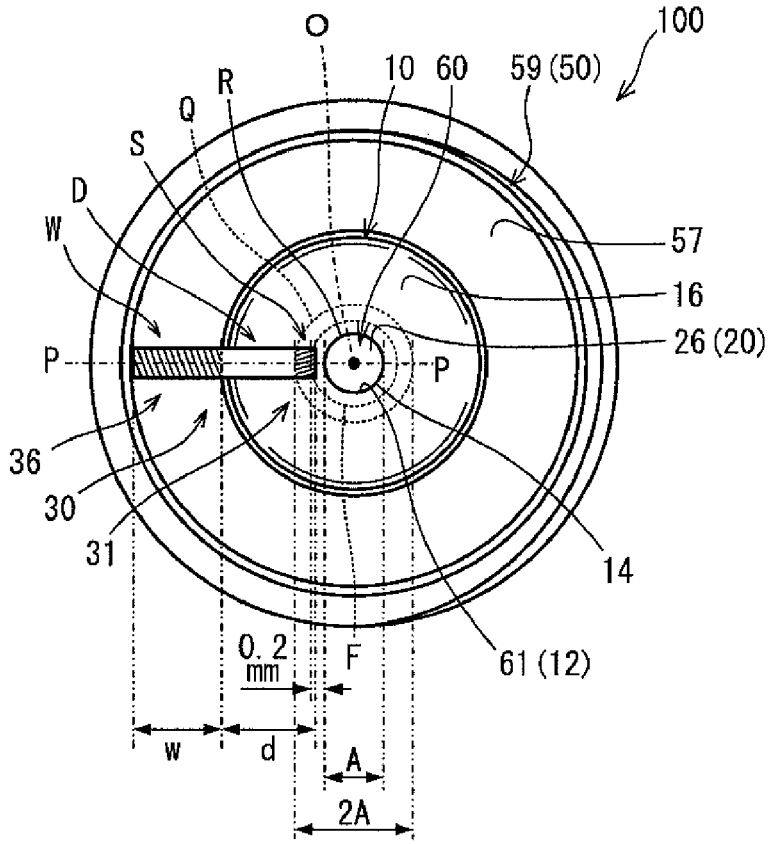
FIG. 3 is a view of the plasma jet ignition plug 100 as viewed from the front side with respect to the direction of an axis O.

A plasma jet ignition plug according to a first embodiment of the present invention will now be described with reference to the drawings. First, taking a plasma jet ignition plug 100 as an example, the structure thereof will be described with reference to FIGS. 1 to 3. FIG. 1 is a vertical sectional view of the plasma jet ignition plug 100. FIG. 2 is an enlarged sectional view of a front end portion of the plasma jet ignition plug 100. FIG. 3 is a view of the plasma jet ignition plug 100 as viewed from the front side with respect to the direction of an axis O. In the following description, the direction of the axis of the plasma jet ignition plug 100 in FIG. 1 is referred to as the vertical direction, and the lower side of the plasma jet ignition plug 100 in FIG. 1 is referred to as the front side of the plasma jet ignition plug 100, and the upper side as the rear side of the plasma jet ignition plug 100.

As shown in FIG. 1, the plasma jet ignition plug 100 has roughly a structure in which a metallic shell 50 circumferentially surrounds an insulator 10. The insulator 10 retains a center electrode 20 in a front end portion of its axial bore 12 and a terminal fitting 40 in a rear end portion of its axial bore 12.

As is well known, the insulator 10 is an electrically insulative member which is formed of alumina or the like by firing, and assumes the form of a tube having the axial bore 12 extending in the direction of the axis O. The insulator 10 has a flange portion 19 located substantially at the center with respect to the direction of the axis O and having the largest outside diameter, and a rear trunk portion 18 located rearward of the flange portion 19. The insulator 10 also has a front trunk portion 17 located frontward of the flange portion 19 and having an outside diameter smaller than that of the rear trunk portion 18 and a leg portion 13 located frontward of the front trunk portion 17 and having an outside diameter smaller than that of the front trunk portion 17. The insulator 10 further has a stepped portion 11 located between the leg portion 13 and the front trunk portion 17.

A portion of the axial bore 12 which corresponds to an inner circumferential region of the leg portion 13 is formed as an electrode-accommodating portion 15 smaller in diameter than a portion of the axial bore 12 which corresponds to inner circumferential regions of the front trunk portion 17, the flange portion 19, and the rear trunk portion 18. The electrode-accommodating portion 15 retains the center electrode 20 therein. A portion of the axial bore 12 which is located frontward of the electrode-accommodating portion 15 is further reduced in diameter so as to serve as a front-end small-diameter portion 61. The front-end small-diameter portion 61 opens at a front end face 16 of the insulator 10 (hereinafter, the front end of the axial bore 12 which opens at the front end face 16 of the insulator 10 is called an "opening end" 14).

Next, the center electrode 20 is a rod-like electrode having a structure in which a core metal 22 is embedded in a base metal 21. The base metal 21 is of Ni or an alloy which contains Ni as a main component, such as INCONEL 600 or 601 (trade name). The core metal 22 is of copper or an alloy which contains copper as a main component, and is higher in thermal conductivity than the base metal 21. A disk-like electrode chip 25 formed of an alloy which contains a noble metal or W as a main component is welded to the front end of the center electrode 20. In the first embodiment the "center electrode" encompasses the electrode chip 25 welded to the center electrode 20.

A portion of the center electrode 20 which is located toward the rear end of the center electrode 20 is increased in diameter, thereby assuming the form of a flange. The flange portion of the center electrode 20 is in contact with a stepped region of the axial bore 12, the stepped region serving as a starting point of the electrode-accommodating portion 15, whereby the center electrode 20 is positioned within the electrode-accommodating portion 15. As shown in FIG. 2, the front end face 26 of the center electrode 20 (more specifically, the front end face 26 of the electrode chip 25, which is integrally joined to a front end portion of the center electrode 20) is located rearward, with respect to the direction of the axis O, of a stepped portion between the electrode-accommodating portion 15 and the front-end small-diameter portion 61, which differ in diameter. This configuration forms a small recess-like space (hereinafter called a "cavity" 60). The circumferential wall surface of the front-end small-diameter portion 61 of the axial bore 12 and a portion of the circumferential wall surface of the electrode-accommodating portion 15 jointly serve as the side wall surface of the cavity 60; the front end face 26 of the center electrode 20 serves as the bottom surface of the cavity 60; and the front end of the axial bore 12 serves as the opening end 14 of the cavity 60.

Next, as shown in FIG. 1, the center electrode 20 is electrically connected to the terminal fitting 40 via an electrically conductive seal substance 4, which is a mixture of metal and glass and is provided in the axial bore 12. The seal substance 4 fixes the center electrode 20 and the terminal fitting 40 in the axial bore 12 while establishing electrical connection therebetween. A high-voltage cable (not shown) is connected to the terminal fitting 40 via a plug cap (not shown), and a high voltage is applied to the terminal fitting 40 for performing spark discharge between the center electrode 20 and a ground electrode 30.

Next, the metallic shell 50 is a tubular metal fitting for fixing the plasma jet ignition plug 100 to an unillustrated engine head of an internal combustion engine. The metallic shell 50 surroundingly retains the insulator 10. The metallic shell 50 is formed of an iron-based material and has a tool engagement portion 51, with which an unillustrated plasma jet ignition plug wrench is engaged, and a mounting screw portion 52 on which are formed external threads to be engaged with a mounting hole (not shown) of the engine head.

The metallic shell 50 has a flange-like seal portion 54 formed between the tool engagement portion 51 and the mounting screw portion 52. An annular gasket 5, which is formed by bending a sheet material, is fitted to a screw neck 49 located between the mounting screw portion 52 and the seal portion 54. When the plasma jet ignition plug 100 is attached to the attachment hole (not shown) of the engine head, the gasket 5 is squeezed and deformed between a seat face 55 of the seal portion 54 and a peripheral region around the opening of the attachment hole, thereby providing a seal therebetween for preventing breakage of gas-tightness of the interior of the engine which could otherwise occur through the mounting hole.

The metallic shell 50 has a thin-walled crimp portion 53 provided rearward of the tool engagement portion 51. The metallic shell 50 also has a buckle portion 58, which, similar to the crimp portion 53, is thin-walled, provided between the seal portion 54 and the tool engagement portion 51. Annular ring members 6 and 7 are disposed between a portion of the metallic shell 50 which ranges from the tool engagement portion 51 to the crimp portion 53, and the rear trunk portion 18 of the insulator 10. Furthermore, a space between the annular ring members 6 and 7 is filled with a powder of talc 9. By means of crimping of the crimp portion 53, the insulator 10 is pressed frontward in the metallic shell 50 via the ring members 6 and 7 and the talc 9. By this procedure, the stepped portion 11 of the insulator 10 is supported, via an annular sheet packing 80, on a stepped portion 56 of the metallic shell 50 which is formed on the inner circumferential surface of the metallic shell 50 at a position corresponding to the mounting screw portion 52, whereby the metallic shell 50 and the insulator 10 are united together. At this time, the sheet packing 80 provides a gas-tight seal between the metallic shell 50 and the insulator 10, thereby preventing outflow of combustion gas. Also, the buckle portion 58 is configured to be deformed outwardly in association with application of compressive force in a crimping process, thereby increasing the stroke of compression of the talc 9 along the direction of the axis O and thus enhancing gas-tightness of the interior of the metallic shell 50.

Next, the ground electrode 30 is provided at a front end 59 of the metallic shell 50. As shown in FIGS. 2 and 3, the ground electrode 30 is a bar-like member; a base end 36 of the ground electrode 30 is joined to the front end 59 of the metallic shell 50; and a distal end 31 of the ground electrode 30 and the center electrode 20 form a spark discharge gap therebetween. More specifically, the ground electrode 30 extends radially inward in the form of a bar from its base end 36, which is joined to the front end 59 of the metallic shell 50, along a diametral direction P (illustrated in FIGS. 2 and 3 by the dash-dot line P-P). The distal end 31 of the ground electrode 30 is disposed in the vicinity of the opening end 14 of the cavity 60 while being in contact with the front end face 16 of the insulator 10 with respect to the direction of the axis O. That is, according to the first embodiment, the ground electrode 30 formed separately from the metallic shell 50 projects from the metallic shell 50 toward the opening end 14 of the cavity 60 along the diametral direction P orthogonal to the axis O. The spark discharge gap is formed between the center electrode 20 and the distal end 31 of the ground electrode 30 via the cavity 60. The ground electrode 30 is formed of a metal having excellent resistance to spark-induced erosion; for example, an Ni alloy, such as INCONEL 600 or 601 (trade name).

In the plasma jet ignition plug 100 of the first embodiment having the above-mentioned structure, when a high voltage is applied between the center electrode 20 and the ground electrode 30, spark discharge is performed therebetween via the cavity 60. Further supply of energy therebetween brings about transition of discharge state, whereby a plasma is formed within the cavity 60. When the plasma expands within the cavity 60 with a resultant increase in pressure, the plasma is emitted from the opening end 14 in the form of a pillar of fire; i.e., in the form of a flame. Since a plasma has high energy and exhibits high ignitability to an air-fuel mixture, the plasma can reliably ignite even a leaner air-fuel mixture. In order to sufficiently utilize such a characteristic of the plasma jet ignition plug 100 and to prevent deterioration in ignitability caused by contact between the plasma and the ground electrode 30 particularly, the distal end 31, which forms the spark discharge gap), the first embodiment specifies the size and position of the ground electrode 30.

Specifically, as shown in FIGS. 2 and 3, the distal end 31 (more specifically, a position on the distal end 31 which is located most radially inward) of the ground electrode 30 is located radially inward (a side toward the axis O), with respect to the diametral direction P orthogonal to the axis O, of a position which is located 0.2 mm radially outward (a side away from the axis O) from the opening end 14 of the cavity 60. In other words, it may be sufficient that, as shown in FIG. 3, the distal end 31 of the ground electrode 30 is located within an imaginary circle F (including the imaginary circle F itself) having a diameter which is 0.4 mm greater than a diameter A of the opening end 14 (within an imaginary circle F having a radius which is 0.2 mm greater than that of the opening end 14). FIG. 3 shows an example of the imaginary circle F by the dotted line.

As mentioned previously, in the plasma jet ignition plug 100, the ground electrode 30 projects from the metallic shell 50 toward the opening end 14 of the cavity 60. Thus, the distal end 31 of the ground electrode 30 is not disposed all around the opening end 14, but is disposed around a portion of the opening end 14. Accordingly, the same position on the opening end 14 is apt to fall in a path of spark discharge. Furthermore, as shown in FIG. 2, the distal end 31 of the ground electrode 30 is in contact with the front end face 16 of the insulator 10. That is, a gap H between the distal end 31 and the front end face 16 is 0 mm. At a relatively low voltage, spark discharge is more likely to occur in the form of creeping discharge along the surface of the insulator or the like than in the form of aerial discharge which occurs in the air. The greater the spark discharge gap, the greater the difference in insulation resistance therebetween at the time of dielectric breakdown. Thus, in the case where the ground electrode 30 is in contact with the insulator 10, spark discharge performed between the ground electrode 30 and the center electrode 20 is apt to follow the following path. The spark discharge assumes the form of creeping discharge which creeps on the front end face 16 of the insulator 10 from the distal end 31 of the ground electrode 30. Then, the creeping discharge passes the opening end 14 and creeps on the circumferential wall surface of the cavity 60 (on the circumferential wall surface of the front-end small-diameter portion 61). Then, the spark discharge is directed toward the center electrode 20. Since the front end face 16 of the insulator 10 and the circumferential wall surface of the cavity 60 are substantially orthogonal to each other, the spark discharge is bent substantially at right angles past the opening end 14. Thus, repetition of spark discharge is apt to erode the surface of the insulator 10, particularly the opening end 14, which assumes the form of a sharp edge; i.e., so-called channeling is apt to occur. In order to inhibit the occurrence of channeling, it may be good practice to locate the distal end 31 of the ground electrode 30 radially inward of the position which is located 0.2 mm radially outward from the opening end 14 of the cavity 60. This practice facilitates not only creeping discharge but also aerial discharge between the distal end 31 and the opening end 14.

In this manner, by means of shortening the distance between the distal end 31 of the ground electrode 30 and the circumferential wall surface of the cavity 60, occurrence of channeling at the opening end 14 can be inhibited, and the path of spark discharge can be laid between the distal end 31 and the circumferential wall surface of the cavity 60. This was confirmed from the test results of Example 1, which will be described later.

Figure 4:
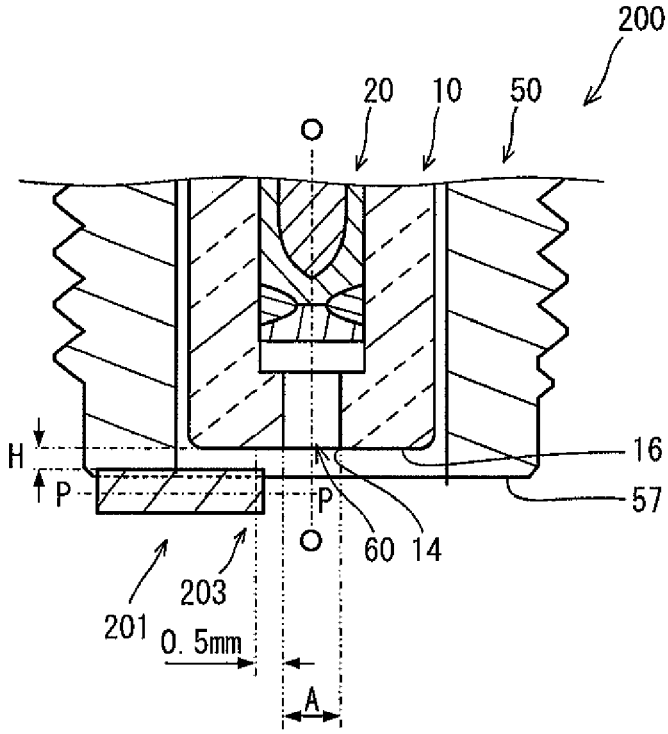
FIG. 4 is an enlarged sectional view of a front end portion of a modified plasma jet ignition plug 200.

As in the case of a plasma jet ignition plug 200 shown in FIG. 4, a distal end 203 of a ground electrode 201 may be disposed apart from the front end face 16 of the insulator 10 with respect to the direction of the axis O (i.e., the gap H>0 [mm]). In this case, it may be sufficient that the distal end 203 of the ground electrode 201 is located radially inward, with respect to the diametral direction P, of the position which is located 0.5 mm radially outward from the opening end 14 of the cavity 60. In other words, it may be sufficient that the distal end 203 is located within an imaginary circle (not shown) having a diameter which is 1.0 mm greater than the diameter A of the opening end 14 (within an imaginary circle having a radius which is 0.5 mm greater than that of the opening end 14). In the case where the ground electrode 201 is not in contact with the insulator 10, spark discharge performed between the ground electrode 201 and the center electrode 20 follows the following path: aerial discharge is performed from the distal end 203 of the ground electrode 201 toward the opening end 14 of the cavity 60; the spark discharge passes the opening end 14; creeping discharge creeps on the circumferential wall surface of the cavity 60; and the spark discharge is directed toward the center electrode 20. Accordingly, creeping discharge on the front end face 16 of the insulator 10 does not occur. In the case of spark discharge between the distal end 203 of the ground electrode 201 and the center electrode 20, when the spark discharge is bent past the opening end 14 between the aerial discharge induced from the distal end 203 and the creeping discharge on the circumferential wall surface of the cavity 60, the path of the spark discharge is apt to be bent with an obtuse angle. This can inhibit the occurrence of channeling in which repetition of spark discharge erodes the surface of the insulator 10, particularly the opening end 14, which assumes the form of a sharp edge. In the case where the distal end 203 of the ground electrode 201 is located further radially outward of the position which is located 0.5 mm radially outward from the opening end 14 of the cavity 60, the angle of bend between the aerial discharge and the creeping discharge at the position of the opening end 14 is further reduced. That is, the angle of bend approaches a right angle; thus, channeling is apt to occur at the opening end 14. This was revealed from the test results of Example 2, which will be described later.

Figure 5:
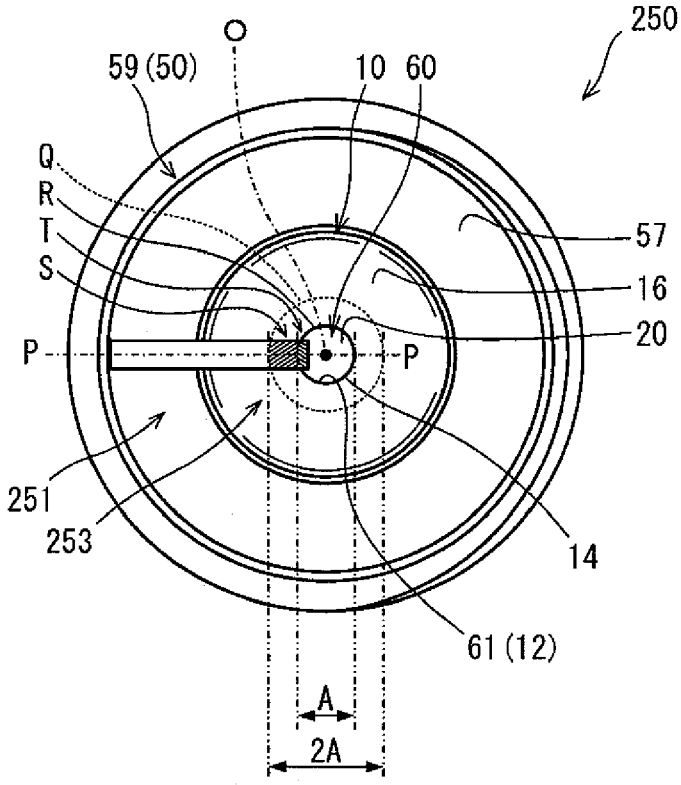
FIG. 5 is a view of a modified plasma jet ignition plug 250 as viewed from the front side with respect to the direction of the axis O.
Figure 6:
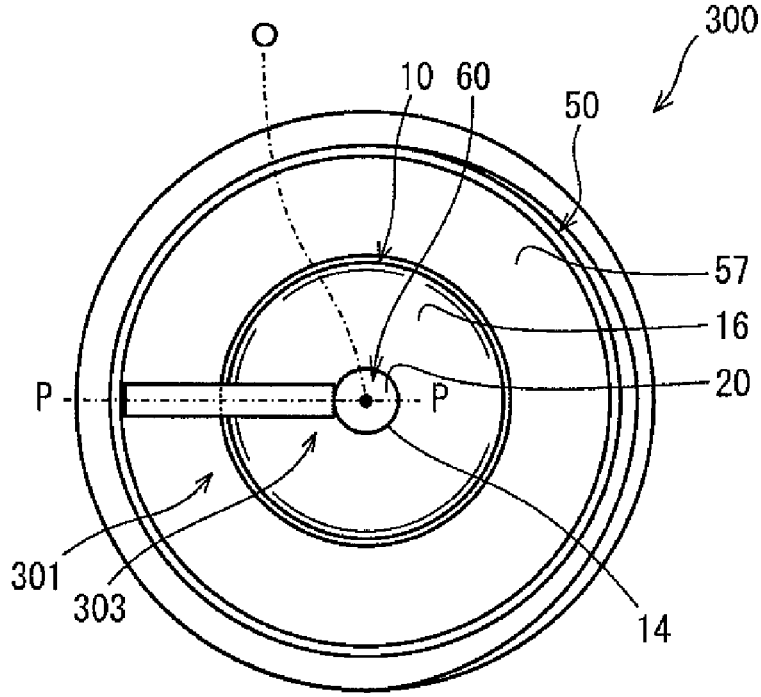
FIG. 6 is a view of a modified plasma jet ignition plug 300 as viewed from the front side with respect to the direction of the axis O.

As mentioned above, in provision of the ground electrode 30, it may be sufficient that the distal end 31 is positioned in relation to the front end face 16 of the insulator 10 such that the distal end 31 is located radially inward of the position which is located 0.2 mm radially outward from the opening end 14 (see FIGS. 2 and 3). In the case where the distal end 203 of the ground electrode 201 is disposed apart from the front end face 16 (in the case of gap H>0 [mm]), it may be sufficient that the distal end 203 is located radially inward of the position which is located 0.5 mm radially outward from the opening end 14 (see FIG. 4). This means that the configuration shown in FIG. 5 is acceptable, in which a distal end 253 of a ground electrode 251 of a plasma jet ignition plug 250 is located radially inward of the opening end 14 of the cavity 60. Of course, as in the case of a ground electrode 301 of a plasma jet ignition plug 300 shown in FIG. 6, a distal end 303 may be located at the position of the opening end 14 of the cavity 60.

In view of inhibiting the occurrence of channeling, the configuration shown in FIG. 3 can be said to be preferred, since the closer the distal end 31 of the ground electrode 30 is located to the opening end 14 of the cavity 60, the greater the angle with which the path of spark discharge is bent past the opening end 14. Thus, the opening end 14 is less likely to be eroded by spark discharge.

However, when the position of the distal end 31 of the ground electrode 30 shown in FIG. 3 is located closer to the cavity 60 as in the case of the distal end 303 (see FIG. 6) and further overlaps with the cavity 60 as in the case of the distal end 253 (see FIG. 5), a plasma is apt to come into contact with the ground electrode 30 in the course of emission from the cavity 60. In emission from the opening end 14, the plasma expands radially and extends frontward along the direction of the axis O. At this time, if the plasma comes into contact with the ground electrode 30, radial expansion is inhibited in a region of the plasma which is in contact with the ground electrode 30. Accordingly, the plasma extends frontward along the direction of the axis O while having a cross section which has a missing portion associated with inhibiting of radial expansion. Thus, energy which is thrust forward drops, thereby raising the risk of deterioration in ignitability to an air-fuel mixture. Also, contact of the plasma with the ground electrode 30 is apt to cause removal of energy from the plasma itself. Thus, when the plasma jet ignition plug 100 is viewed from the front side with respect to the direction of the axis O, a percentage of the front end face 16 of the insulator 10 accounted for by the ground electrode 30 is specified.

The paper on which FIG. 3 appears is assumed to be an imaginary plane orthogonal to the axis O. In the imaginary plane, the letter R represents the outline of the opening end 14 of the cavity 60. Furthermore, an imaginary boundary line Q (represented by the dotted line in FIG. 3) concentric with the opening end 14 of the cavity 60 and having a diameter 2A which is two times the diameter A of the opening end 14 is assumed. The first embodiment specifies that, as viewed on the imaginary plane on which the ground electrode 30 is projected, the projected area of a portion S (in FIG. 3, the portion hatched with diagonal lines which slope down to the left) of the ground electrode 30, the portion S being disposed within a region lying between the imaginary boundary line Q and the outline R, is 30% or less of the area enclosed by the imaginary boundary line Q.

In order to restrain inhibition of the ground electrode 30 to radial expansion of plasma while inhibiting channeling by means of bringing the distal end 31 of the ground electrode 30 close to the opening end 14 as mentioned above, it may be good practice to reduce the size of a portion of the ground electrode 30 in the vicinity of the opening end 14, particularly the size of a portion of the ground electrode 30 located toward the distal end 31. According to the test results of Example 3, which will be described later, sufficient ignitability can be ensured when, as viewed on the imaginary plane on which the ground electrode 30 is projected, the projected area of the portion S disposed within the region lying between the imaginary boundary line Q and the outline R is 30% or less of the area enclosed by the imaginary boundary line Q.

Further, as shown in FIG. 5, in the case where the distal end 253 of the ground electrode 251 is located radially inward of the opening end 14 of the cavity 60, similar to the above, the ground electrode 251 is projected on an imaginary plane (the paper on which FIG. 5 appears) orthogonal to the axis O. At this time, the projected area of a portion T (in FIG. 5, the portion hatched with diagonal lines which slope down to the right) disposed within the outline R of the opening end 14 of the cavity 60 is specified to be 15% or less of the area enclosed by the outline R.

In the case where the distal end 253 of the ground electrode 251 is located radially inward of the opening end 14 of the cavity 60, a portion of the ground electrode 251 is located in the path of emission of plasma emitted from the cavity 60. Thus, emission of plasma is partially obstructed, and energy which is thrust forward drops. According to the test results of Example 4, which will be described later, sufficient ignitability can be ensured when, as viewed on the imaginary plane on which the ground electrode 251 is projected, the projected area of the portion T disposed within the outline R of the opening end 14 is 15% or less of the area enclosed by the outline R. Even in this case, preferably, the projected area of the portion S (in FIG. 5, the portion hatched with diagonal lines which slope down to the left) of the ground electrode 251, the portion S being disposed within the region lying between the imaginary boundary line Q and the outline R, is 30% or less of the area enclosed by the imaginary boundary line Q.

Next, as shown in FIG. 3, on the imaginary plane (the paper on which FIG. 3 appears) orthogonal to the axis O, the letter W represents a weld portion (in FIG. 3, the portion hatched with diagonal lines which slope down to the right) of the ground electrode 30 which is located toward the base end 36 of the ground electrode 30 and is joined to a front end face 57 of the metallic shell 50 by known resistance welding or laser welding. A portion of the ground electrode 30 which extends from the weld portion W toward the distal end 31 is defined as an extension portion D. With respect to the diametral direction P orthogonal to the axis O on the imaginary plane, the length of the weld portion W is taken as w, and the length of the extension portion D is taken as d. Notably, the length w of the weld portion W is defined as the length of a portion of the ground electrode 30 which is free from the influence of alloying associated with fusion between the ground electrode 30 and the metallic shell 50, and the length d of the extension portion D is defined as the difference obtained by subtracting the length w from the length of the ground electrode 30 along the diametral direction P. In this connection, the first embodiment specifies the relation $d/(d+w) \leqq 0.8$.

As the length d of the extension portion D increases, the length w of the weld portion W decreases, and the area of the weld portion W reduces. When the area of the weld portion W is small, a joint region between the ground electrode 30 and the metallic shell 50 may fail to provide sufficient joining strength. According to the test results of Example 5, which will be described later, when the length d of the extension portion D is 80% or less of the overall length (d+w) of the ground electrode 30, the joint region between the ground electrode 30 and the metallic shell 50 can provide sufficient joining strength.

Figure 7:
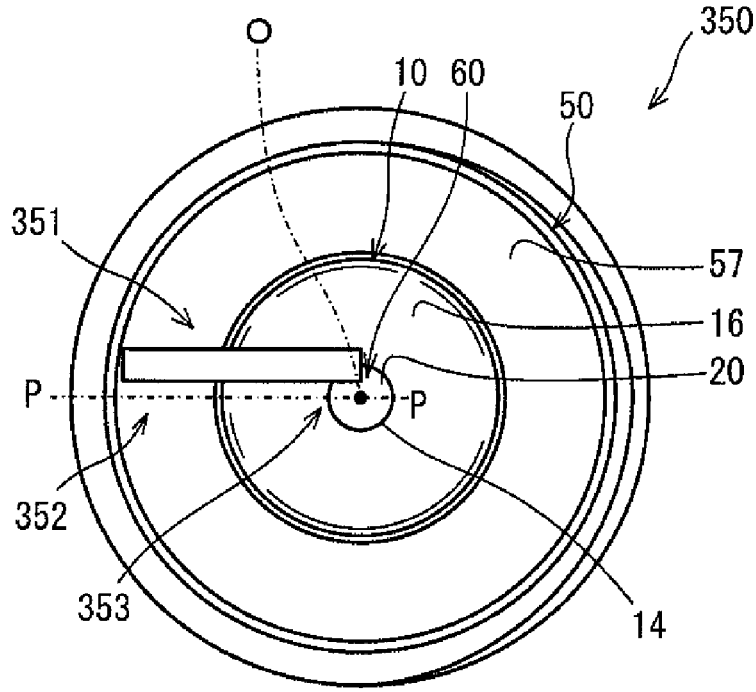
FIG. 7 is a view of a modified plasma jet ignition plug 350 as viewed from the front side with respect to the direction of the axis O.

Needless to say, the plasma jet ignition plug according to the first embodiment of the present invention can be modified in various forms. For example, the direction along which the ground electrode 30 projects from the metallic shell 50 does not necessarily coincide with the diametral direction P; i.e., the metallic shell 50 does not necessarily project toward the axis O. In other words, the metallic shell 50 does not necessarily project along a radial direction orthogonal to the axis O. Specifically, as in the case of a plasma jet ignition plug 350 shown in FIG. 7, as viewed on an imaginary plane (the paper on which FIG. 7 appears) orthogonal to the axis O, a ground electrode 351 may extend from the position of joint between a base end 352 of the ground electrode 351 and the front end face 57 of the metallic shell 50 toward the interior of the opening end 14 of the cavity 60 along a direction in parallel with a radial direction. The projecting direction of the ground electrode 351 may deviate from the center of the opening end 14 of the cavity 60 (i.e., the position of the axis O) such that a distal end 353 of the ground electrode 351 does not face the center electrode 20 through the cavity 60 on the front side with respect to the projecting direction of the ground electrode 351.

Figure 8:
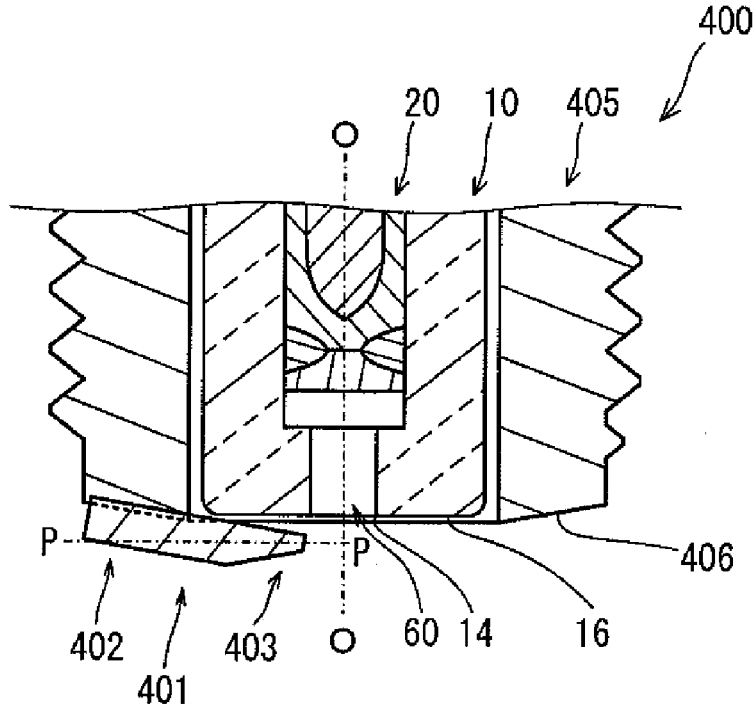
FIG. 8 is an enlarged sectional view of a front end portion of a modified plasma jet ignition plug 400.

Also, the projecting direction of the ground electrode may deviate from the diametral direction P along the direction of the axis O. For example, in the case of a plasma jet ignition plug 400 shown in FIG. 8, a front end face 406 of a metallic shell 405 is tapered. When a base end 402 of a bar-like ground electrode 401 is joined to the front end face 406, the direction along which the ground electrode 401 projects from the metallic shell 405 is oblique to the diametral direction P. Even in the thus-configured plasma jet ignition plug 400, if a distal end 403 of the ground electrode 401 is disposed at a position which satisfies the above-mentioned specifications, occurrence of channeling can be inhibited while sufficient ignitability is ensured.

Figure 9:
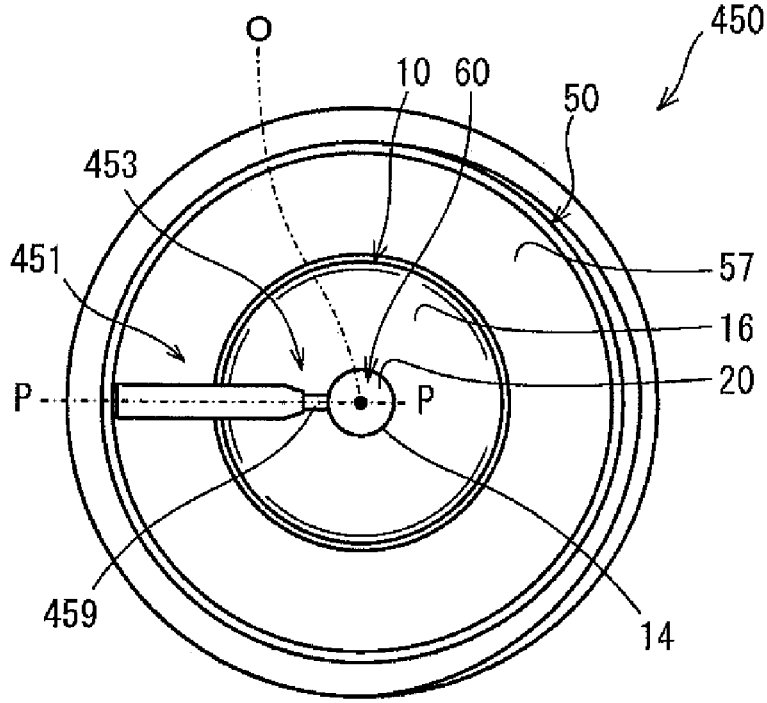
FIG. 9 is a view of a modified plasma jet ignition plug 450 as viewed from the front side with respect to the direction of the axis O.

Also, as in the case of a plasma jet ignition plug 450 shown in FIG. 9, a noble metal chip 459 formed of a noble metal or an alloy which contains a noble metal as a main component may be joined to a distal end 453 of a ground electrode 451. In this case, the body of the ground electrode 451 and the noble metal chip 459 integrated with the body may be collectively called the ground electrode 451. Even when the noble metal chip 459 having high resistance to spark-induced erosion is of a size smaller than the width and the diameter of the body of the ground electrode 451, the noble metal chip 459 can provide sufficient durability Thus, the distal end 453 of the ground electrode 451 including the noble metal chip 459 can be reduced in degree of its a real occupation in the vicinity of the opening end 14 of the cavity 60. Accordingly, the radial expansion of plasma emitted from the cavity 60 is less likely to be inhibited, whereby ignitability of the plasma jet ignition plug 450 can be ensured. When the range of contact of the ground electrode 451 with plasma is reduced, the plasma is less susceptible to removal of energy therefrom which is caused by contact with the ground electrode 451. Therefore, the distal end 453 of the ground electrode 451 can be brought closer to the position of the opening end 14 of the cavity 60 with respect to the diametral direction P, whereby occurrence of channeling can be effectively inhibited.

Figure 10:
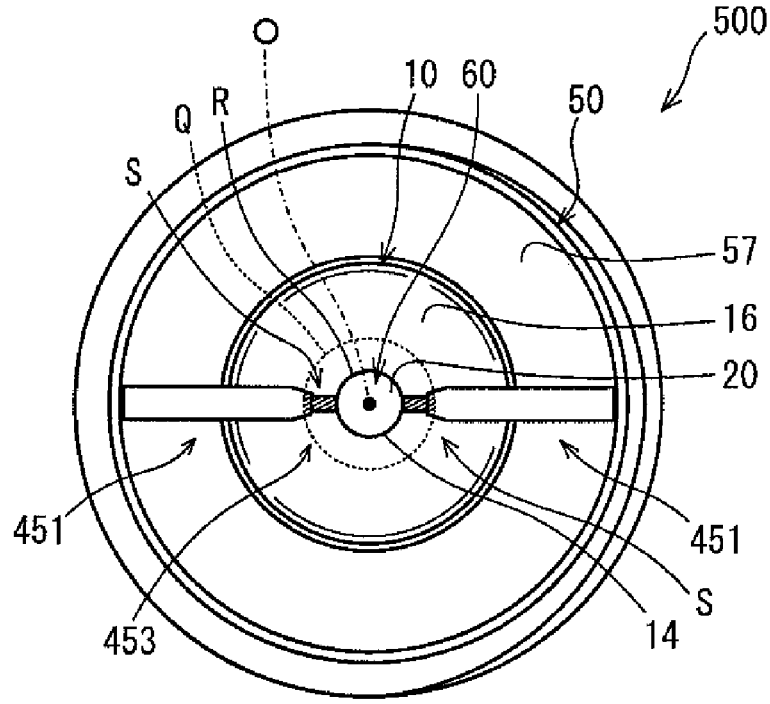
FIG. 10 is a view of a modified plasma jet ignition plug 500 as viewed from the front side with respect to the direction of the axis O.
Figure 11:
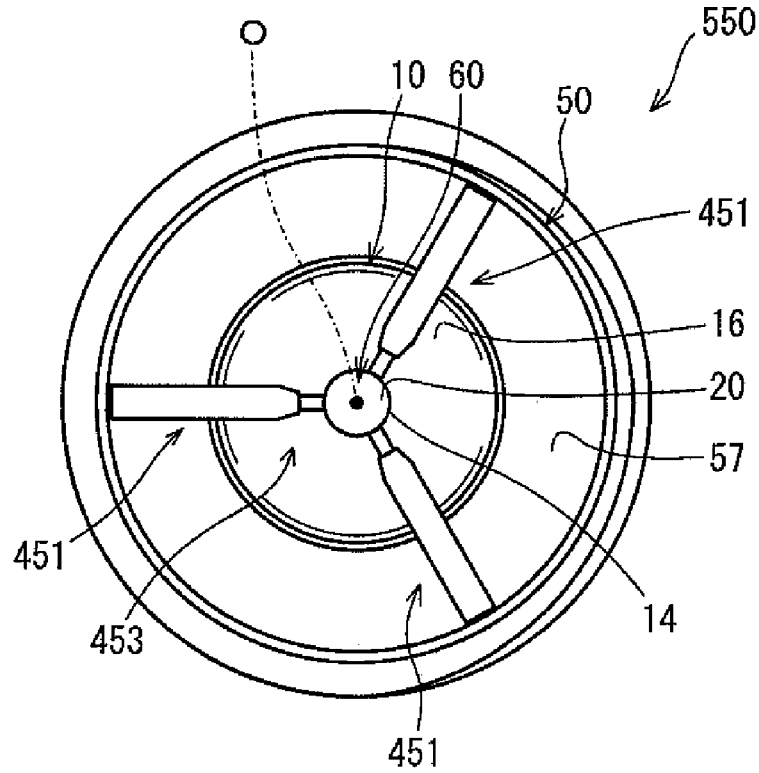
FIG. 11 is a view of a modified plasma jet ignition plug 550 as viewed from the front side with respect to the direction of the axis O.

When the size of a portion of the ground electrode 451 located toward the distal end 453 can be reduced by use of a noble metal, the following advantage is yielded: even when a plurality of the ground electrodes 451 are provided, as viewed on an imaginary plane orthogonal to the axis O, the projected area of portions S of the ground electrodes 451 (in FIG. 10, the portions hatched with diagonal lines which slope down to the left) disposed within the imaginary boundary line Q can be readily adjusted so as to be 30% or less of the area enclosed by the imaginary boundary line Q. Specifically, as in the case of a plasma jet ignition plug 500 shown in FIG. 10 and a plasma jet ignition plug 550 shown in FIG. 11, a configuration which employs two, three, or more ground electrodes 451 can be readily implemented. When a plurality of the ground electrodes 451 are provided around the opening end 14 of the cavity 60, a plurality of spark discharge gaps can be formed in a dispersed fashion. As compared with the case where only a single path of spark discharge is provided, the employment of a plurality of the ground electrodes 451 is preferred, since erosion of the opening end 14 caused by channeling can be inhibited. A plurality of ground electrodes each having no noble metal chip joined to its distal end may be provided.

Figure 12:
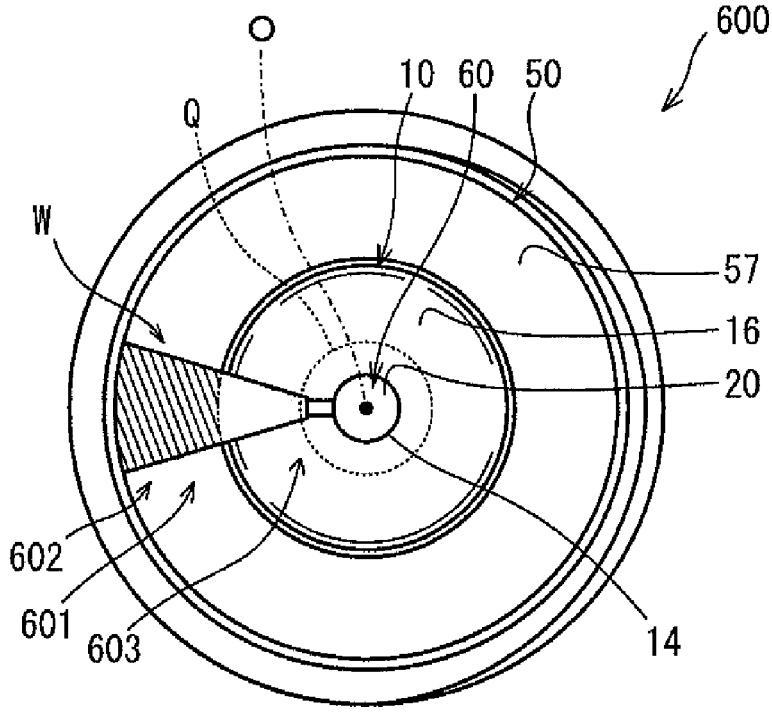
FIG. 12 is a view of a modified plasma jet ignition plug 600 as viewed from the front side with respect to the direction of the axis O.

The shape of the ground electrode is desirably a bar-like shape as in the case of the first embodiment. However, the shape is not limited to a bar-like shape, so long as the ground electrode projects from the metallic shell such that its distal end is located near the opening end of the cavity. For example, as in the case of a plasma jet ignition plug 600 shown in FIG. 12, a ground electrode 601 may assume the form of, for example, a plate. That is, the ground electrode 601 suffices so long as the ground electrode 601 projects from the metallic shell 50 toward the opening end 14 of the cavity 60 (from the radial outside toward the radial inside) such that a distal end 603 is located in the vicinity of the opening end 14. More preferably, the ground electrode 601 satisfies the aforementioned specifications. By virtue of the ground electrode 601 assuming the form of such a plate, the weld portion W of the ground electrode 601 which is located toward a base end 602 and is welded to the front end face 57 of the metallic shell 50 can assume a wide area, whereby joining strength therebetween can be enhanced. Furthermore, as in the case of the ground electrode 601, by means of reducing the width (length as measured along a direction perpendicular to the projecting direction) of the ground electrode 601 toward its distal end 603, the projected area of a portion of the ground electrode 601 disposed within the imaginary boundary line Q can be reduced, whereby ignitability can be ensured.

Figure 13:
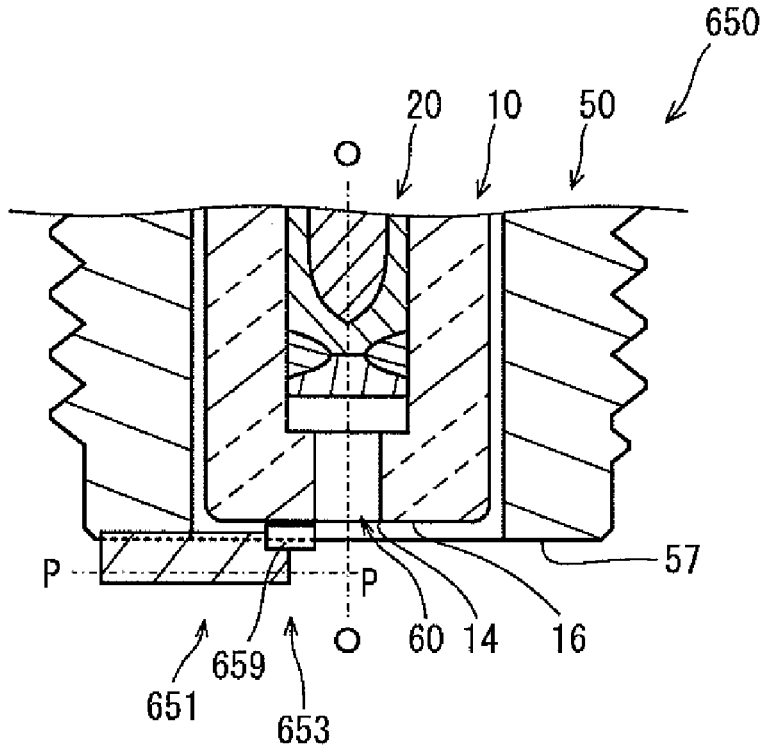
FIG. 13 is an enlarged sectional view of a front end portion of a modified plasma jet ignition plug 650.

As in the case of a plasma jet ignition plug 650 shown in FIG. 13, it may be good practice to join a noble metal chip 659 to a distal end 653 of a ground electrode 651 such that the joining position is located on a side toward the cavity 60 (on a side facing the front end face 16 of the insulator 10). This enables spark discharge between the ground electrode 651 and the center electrode 20 to be reliably performed via the noble metal chip 659. In order to prevent detachment of the noble metal chip 659 from the distal end 653 of the ground electrode 651, the size of the distal end 653 of the ground electrode 651 may be increased so as to widen a joint region between the distal end 653 and the noble metal chip 659. However, as mentioned previously, in order to inhibit impeding radial expansion of plasma emitted from the cavity 60, it is preferable to reduce the size of a portion of the ground electrode 651 located toward the distal end 653. Therefore, the size of the noble metal chip 659 which faces a spark discharge gap is desirably small. Thus, as shown in FIG. 13, by means of disposing the noble metal chip 659 in such a manner as to be held between the distal end 653 of the ground electrode 651 and the front end face 16 of the insulator 10, even when the noble metal chip 659 has a small form, the noble metal chip 659 can sufficiently maintain its state of being joined to the ground electrode 651, whereby detachment of the noble metal chip 659 can be prevented. Therefore, a portion of the ground electrode 651 located toward the distal end 653 can also have a small form.

Figure 14:
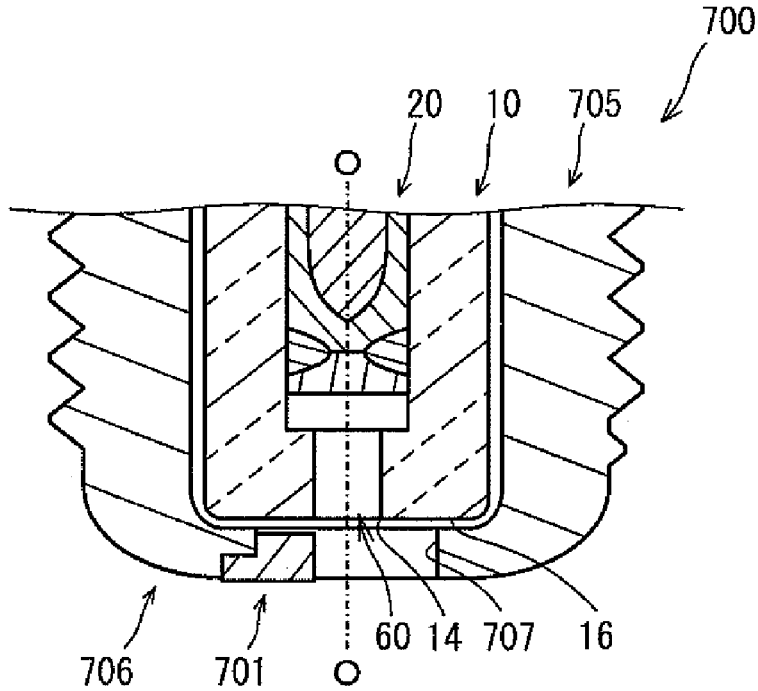
FIG. 14 is an enlarged sectional view of a front end portion of a modified plasma jet ignition plug 700.
Figure 15:
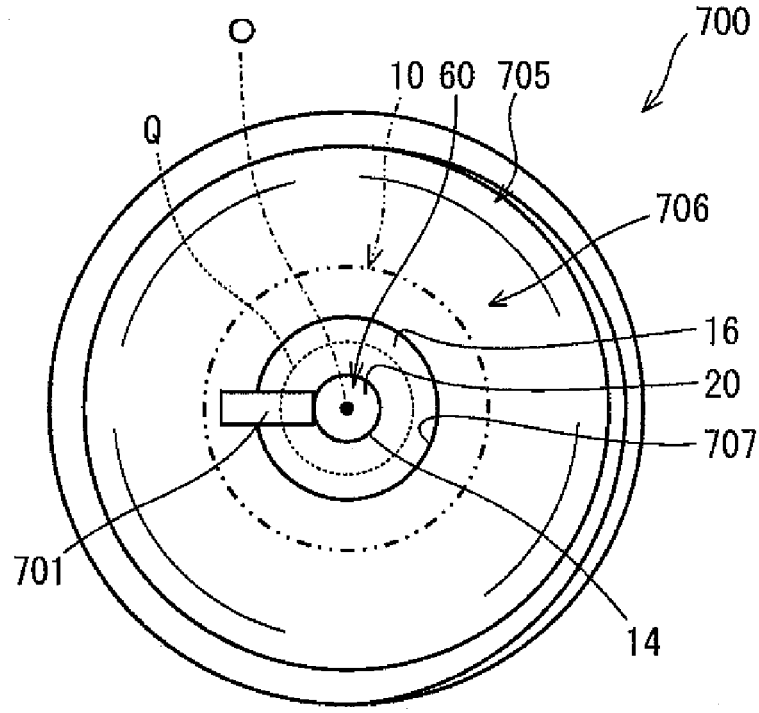
FIG. 15 is a view of the modified plasma jet ignition plug 700 as viewed from the front side with respect to the direction of the axis O.

As in the case of a plasma jet ignition plug 700 shown in FIGS. 14 and 15, a front end portion 706 of a metallic shell 705 may be bent inward such that a front end face 707 of the metallic shell 705 faces radially inward, and a ground electrode 701 may be joined to the front end portion 706. By virtue of such a configuration of the plasma jet ignition plug 700, the length of the ground electrode 701 projecting from the metallic shell 705 toward the opening end 14 can be shortened. That is, the ground electrode 701 can reduce its own weight, thereby reducing the influence of load associated with its own weight on the joint region between the ground electrode 701 and the metallic shell 705. However, in view of secure ignitability, desirably, as shown in FIG. 15, the position of the front end face 707 after bending of the front end portion 706 is adjusted such that the front end portion 706 of the metallic shell 705 does not project into the inside of the imaginary boundary line Q.

Figure 16:
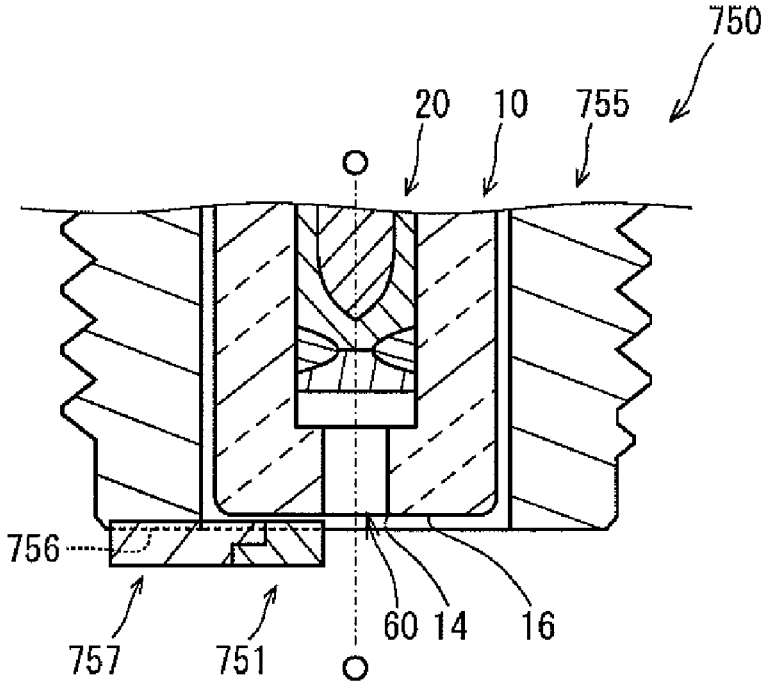
FIG. 16 is an enlarged sectional view of a front end portion of a modified plasma jet ignition plug 750.
Figure 17:
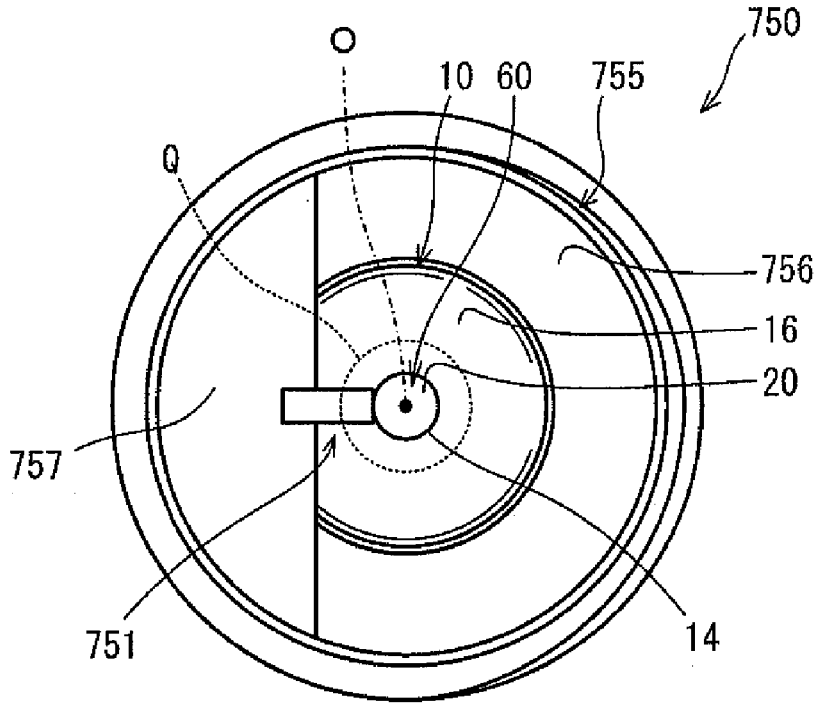
FIG. 17 is a view of the modified plasma jet ignition plug 750 as viewed from the front side with respect to the direction of the axis O.

Alternatively, as in the case of a plasma jet ignition plug 750 shown in FIGS. 16 and 17, an auxiliary plate 757 may be joined to a front end face 756 of a metallic shell 755 in such a manner as to cover a portion of the front end face 16 of the insulator 10, and a ground electrode 751 may be joined to the auxiliary plate 757. Even in this case, similar to the above-mentioned plasma jet ignition plug 700 (see FIG. 15), by means of shortening the projecting length of the ground electrode 751 projecting from the metallic shell 755 toward the opening end 14, the influence of load associated with its own weight of the ground electrode 751 on the joint region between the ground electrode 751 and the auxiliary plate 757 can be reduced. Also, in view of secure ignitability, desirably, as shown in FIG. 17, the joint region between the auxiliary plate 757 and the front end face 756 of the metallic shell 755 is expanded while adjusting the form of the auxiliary plate 757 such that the auxiliary plate 757 does not project into the inside of the imaginary boundary line Q.

Figure 18:
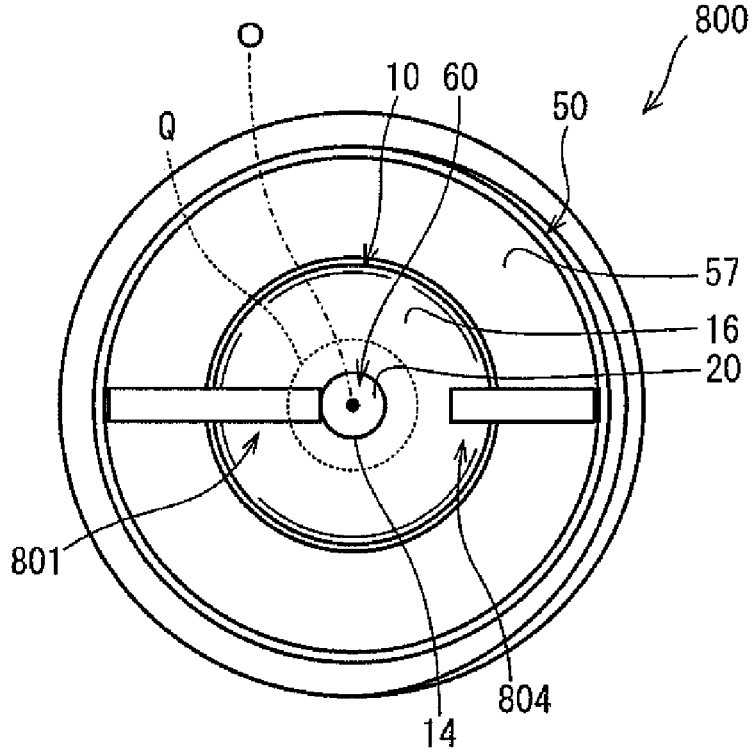
FIG. 18 is a view of a modified plasma jet ignition plug 800 as viewed from the front side with respect to the direction of the axis O.
Figure 19:
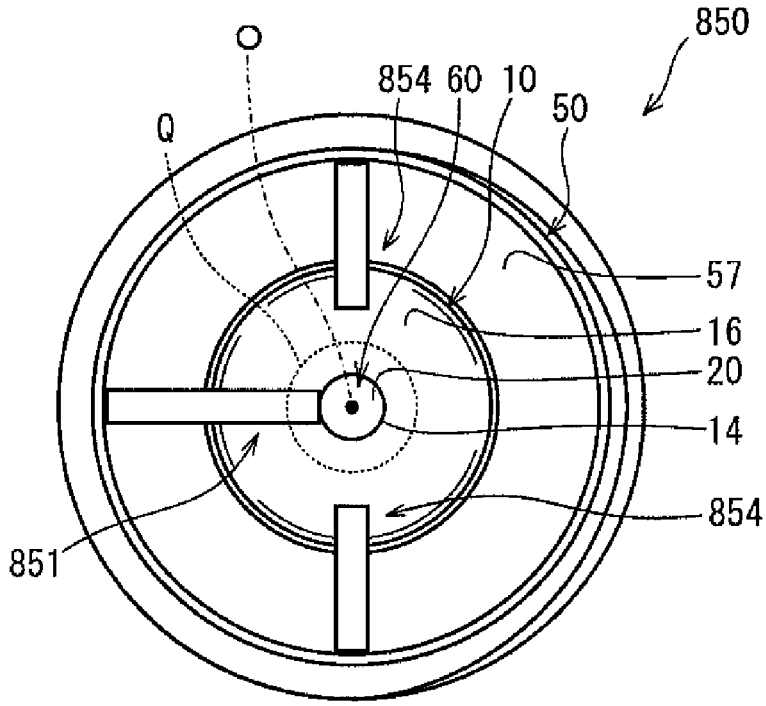
FIG. 19 is a view of a modified plasma jet ignition plug 850 as viewed from the front side with respect to the direction of the axis O.

Also, as in the case of plasma jet ignition plugs 800 and 850 shown in FIGS. 18 and 19, respectively, in addition to ground electrodes 801 and 851 similar to that of the first embodiment, auxiliary electrodes 804 and 854 may be provided. The plasma jet ignition plug 800 has a single auxiliary electrode 804, whereas the plasma jet ignition plug 850 has two auxiliary electrodes 854. The auxiliary electrodes 804 and 854 are shorter than the ground electrodes 801 and 851 in the length of projection from the metallic shell 50 toward the opening end 14 of the cavity 60 so as not to project into the inside of the imaginary boundary line Q. The provision of the auxiliary electrodes 804 and 854 enhances electric field intensity around the ground electrodes 801 and 851, thereby enabling spark discharge between the center electrode 20 and the ground electrodes 801 and 851 with a lower voltage. Accordingly, as viewed along the path of spark discharge, energy of spark discharge which is consumed to erode the opening end 14 when the spark discharge passes the opening end 14 is reduced, whereby channeling can be inhibited.

Figure 20:
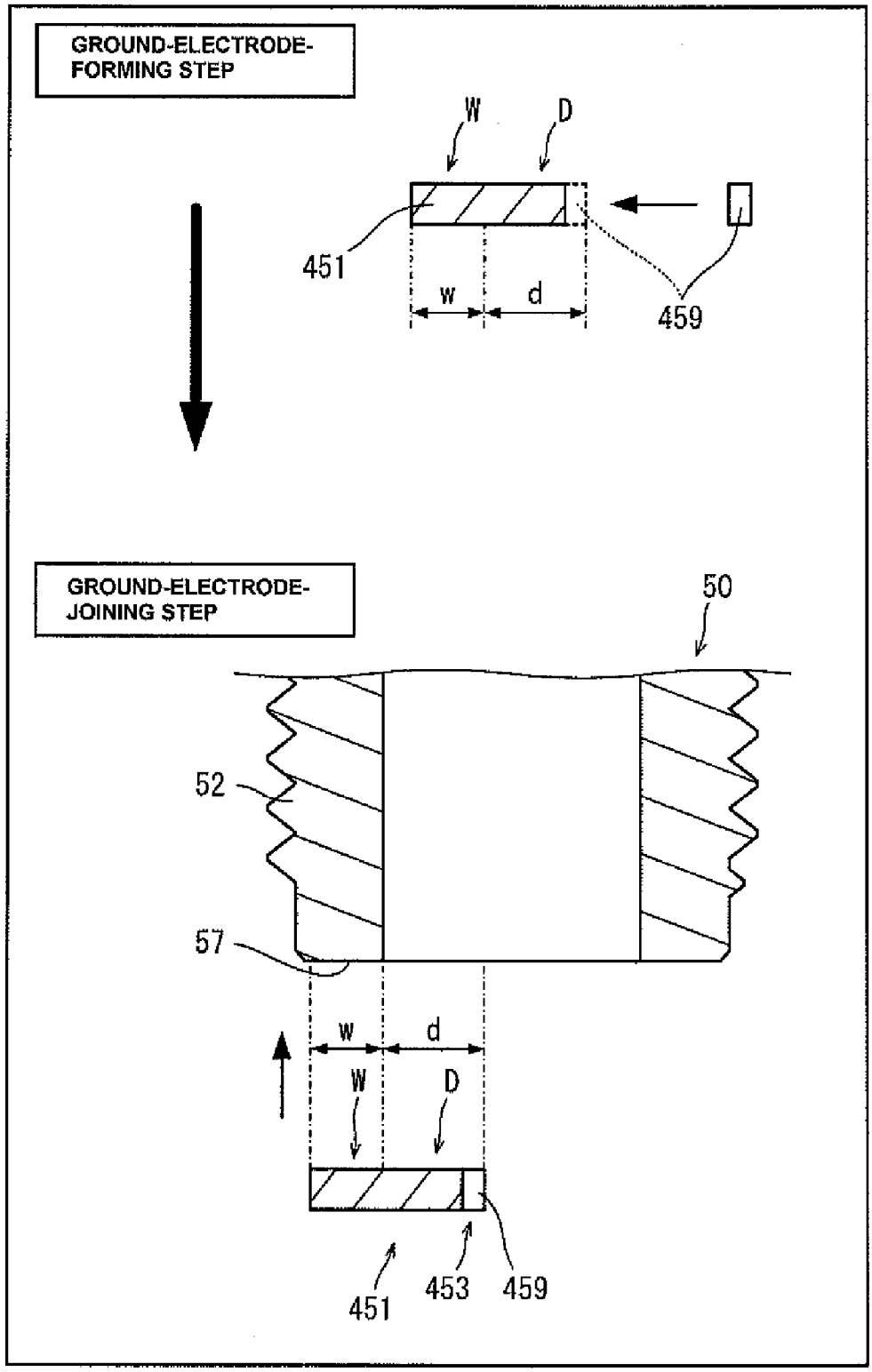
FIG. 20 is a view showing a manufacturing process for the plasma jet ignition plug 450.

Desirably, a manufacturing process which is described below is followed to manufacture the plasma jet ignition plug 450 (see FIG. 9) in which a noble metal or an alloy which contains a noble metal as a main component is used to form the distal end 453 of the ground electrode 451. The manufacturing process for the plasma jet ignition plug 450 will be described with reference to FIG. 20 while the description centers on a step of joining the ground electrode 451 to the metallic shell 50. A known portion of the manufacturing process is partially simplified or omitted. FIG. 20 shows the manufacturing process for the plasma jet ignition plug 450.

In the manufacturing process for the plasma jet ignition plug 450, a wire which is made of an Ni alloy having high corrosion resistance (e.g., INCONEL 601), or a like material and which has a rectangular cross section is cut into a piece having a predetermined length, thereby forming the rectangular-parallelepiped-shaped ground electrode 451 shown in FIG. 20. At this time, the weld portion W is set for the ground electrode 451. The weld portion W serves as a joining allowance in joining the ground electrode 451 to the front end face 57 of the metallic shell 50, which is manufactured in a separate process. The weld portion W is set such that its length w assumes a predetermined value as measured along the diametral direction P of the completed plasma jet ignition plug 450 (see FIG. 9). That is, the ground electrode 451 including the weld portion W is manufactured such that, in a completed state of the ground electrode 451 (a state in which the noble metal chip 459, which will be described later, is joined thereto), the length w of the weld portion W and the length d of the extension portion D extending from the weld portion W toward the distal end 453 satisfy the aforementioned relation $d/(d+w) \leqq 0.8$. The weld portion W may be formed such that a step is formed between the weld portion W and the other portion, for facilitating positioning of the distal end 453 of the ground electrode 451 and for readily securing the length w of the weld portion W at the time of joining of the ground electrode 451 to the metallic shell 455, which will be described later. Of course, the shape of the weld portion W may be adjusted as appropriate so as to be compatible with the front end face 57 of the metallic shell 50. By means of presetting the size of the weld portion W, variations among production lots can be inhibited, hereby enabling formation of a reliable weld zone (where components of the ground electrode and the metallic shell are mixedly fused together when the ground electrode and the metallic shell are joined together).

In a separate step, the noble metal chip 459 whose cross section is smaller than that of the ground electrode 451 and which assumes the form of a rectangular parallelepiped is manufactured from a noble metal alloy. The noble metal chip 459 is laser-welded to the distal end 453 of the ground electrode 451, the distal end 453 being located opposite the weld portion W with respect to the longitudinal direction of the ground electrode 451. By this procedure, the ground electrode 451 and the noble metal chip 459 are integrated together (ground-electrode-forming step).

In the above-mentioned formation of the ground electrode 451, it may be good practice to taper the ground electrode 451 beforehand as shown in FIG. 9 such that the width decreases from a side toward the weld portion W to a side toward the noble metal chip 459 while a joining area for joining to the noble metal chip 459 is secured at the distal end 453 of the ground electrode 451. This yields the following advantage: after completion of the plasma jet ignition plug 450, there can be a reduction in the area occupied by the distal end 453 of the ground electrode 451, including the noble metal chip 459, on an imaginary plane orthogonal to the axis O.

Meanwhile, as shown in FIG. 20, a tubular body (not shown) formed of an iron material is subjected to cutting so as to form a flange portion, a tool engagement portion, etc. The resultant workpiece is subjected to thread cutting so as to form the mounting screw portion 52. The metallic shell 50 is thus completed. The ground electrode 451 formed in the ground-electrode-forming step is disposed in such a manner that its weld portion W faces the front end face 57 of the metallic shell 50. Then, the ground electrode 451 is joined to the metallic shell 50 by resistance welding (ground-electrode-joining step).

In a separate step, the insulator 10 is fabricated such that the center electrode 20 and the terminal fitting 40 (see FIG. 1) are assembled thereto. The thus-assembled insulator 10 is inserted into a tubular bore of the metallic shell 50 and is then retained by means of crimping. The plasma jet ignition plug 450 shown in FIG. 9 is thus completed. As in the case of the plasma jet ignition plug 100 shown in FIG. 1, when the ground electrode 30 is formed of a single member, the above-mentioned ground-electrode-forming step may be omitted.

Figure 21:
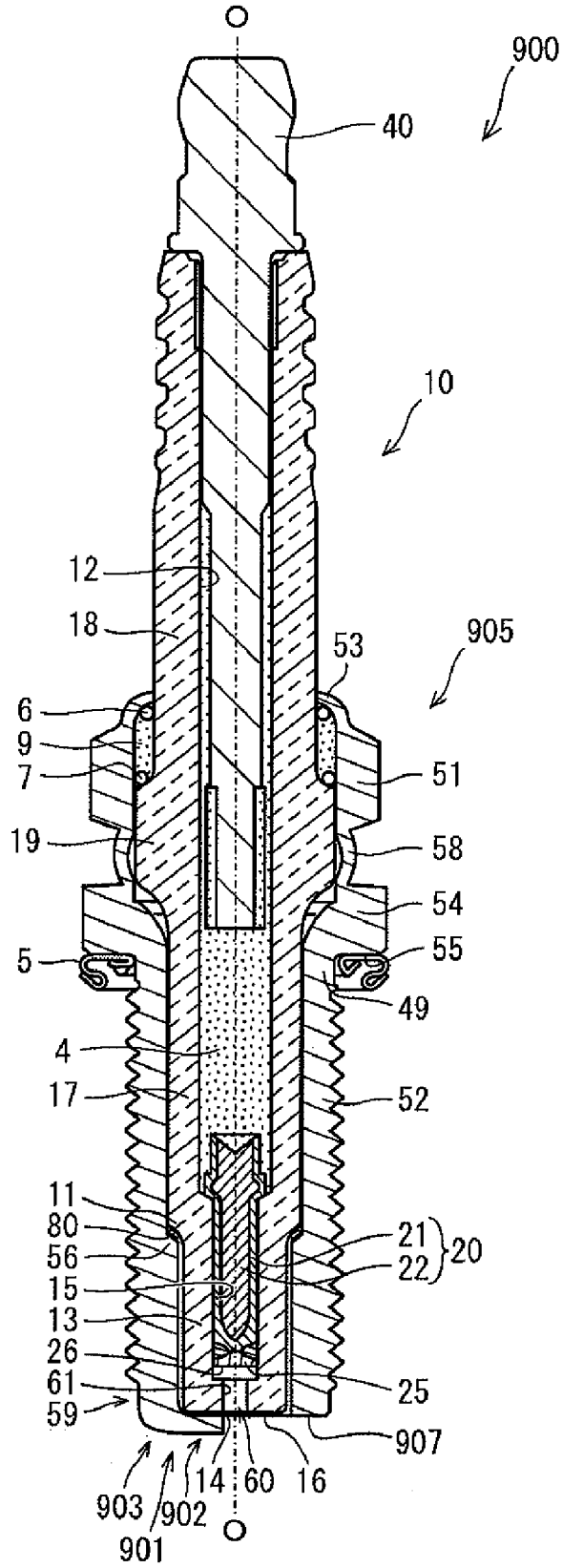
FIG. 21 is a vertical sectional view of a plasma jet ignition plug 900.

Next, a second embodiment of the present invention will be described with reference to FIGS. 21 to 23. A plasma jet ignition plug 900 of the second embodiment shown in FIG. 21 is similar in configuration to the plasma jet ignition plug 100 (see FIG. 1) of the first embodiment, except that a ground electrode 901 is integrally formed with a metallic shell 905 as a portion of the metallic shell 905. In the following description, features different from those of the plasma jet ignition plug 100 will be described. Like structural features are denoted by like reference numerals, and description thereof will be omitted or made brief.

Figure 22:
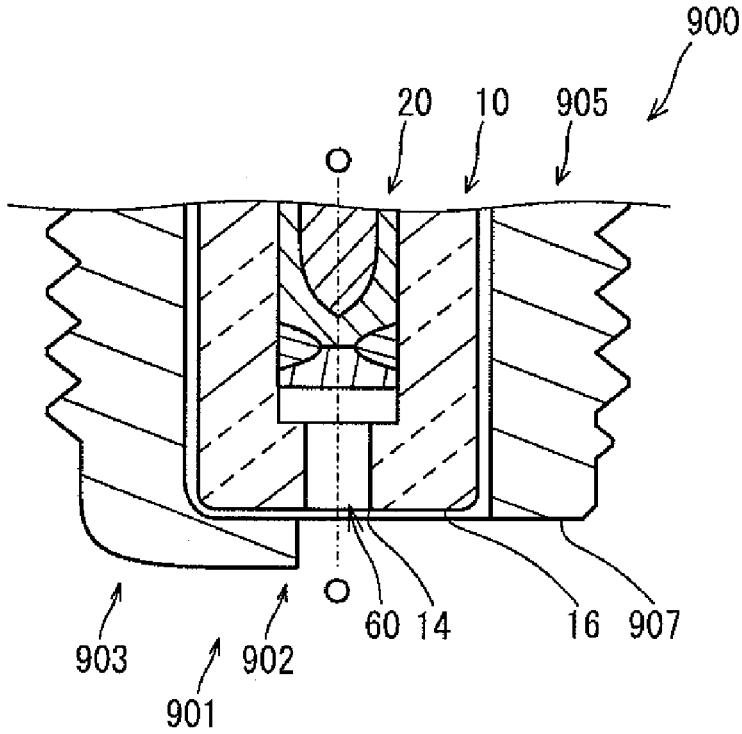
FIG. 22 is an enlarged sectional view of a front end portion of the modified plasma jet ignition plug 900.
Figure 23:
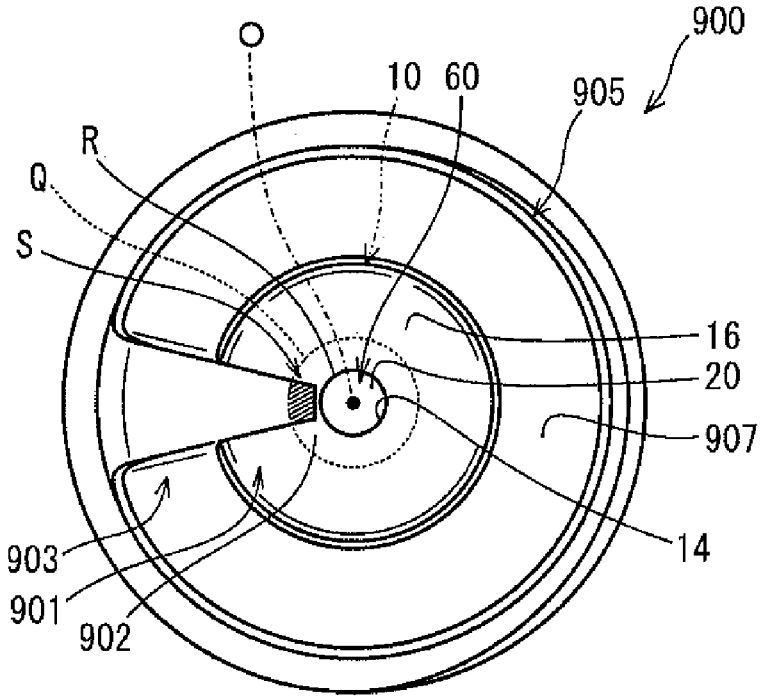
FIG. 23 is a view of the modified plasma jet ignition plug 900 as viewed from the front side with respect to the direction of the axis O.

As shown in FIGS. 21 to 23, in the plasma jet ignition plug 900, the ground electrode 901 is integrally formed with the metallic shell 905 as a portion of the metallic shell 905. Specifically, in formation of the ground electrode 901, a portion of a front end face 907 of the metallic shell 905 is projected frontward along the direction of the axis O. Then, the portion which will become the ground electrode 901 is bent radially inward about a base end 903 such that a distal end 902 is located in the vicinity of the opening end 14 of the cavity 60, so as to form a spark discharge gap between the distal end 902 of the ground electrode 901 and the center electrode 20. By this procedure, the ground electrode 902 projects from the radial outside to the radial inside. Other portions of the plasma jet ignition plug 900 (see FIG. 21) are similar in configuration to those of the plasma jet ignition plug 100 (see FIG. 1).

Even in the thus-configured plasma jet ignition plug 900, as in the case of the first embodiment, it may be sufficient that the distal end 902 of the ground electrode 901 is located radially inward of the position which is located 0.5 mm (0.2 mm in the case where the ground electrode 901 is in contact with the front end face 16 of the insulator 10) radially outward from the opening end 14 of the cavity 60. Also, as shown in FIG. 23, as in the case of the first embodiment, it may be sufficient that, as viewed on an imaginary plane which is orthogonal to the axis O and on which the ground electrode 901 is projected, the projected area of the portion S (in FIG. 23, the portion hatched with diagonal lines which slope down to the left) of the ground electrode 901, the portion S being disposed within a region lying between the imaginary boundary line Q and the outline R, is 30% or less of the area enclosed by the imaginary boundary line Q. It may also be sufficient that the projected area of a portion of the ground electrode disposed within the outline R of the opening end 14 is 15% or less of the area enclosed by the outline R.

Figure 24:
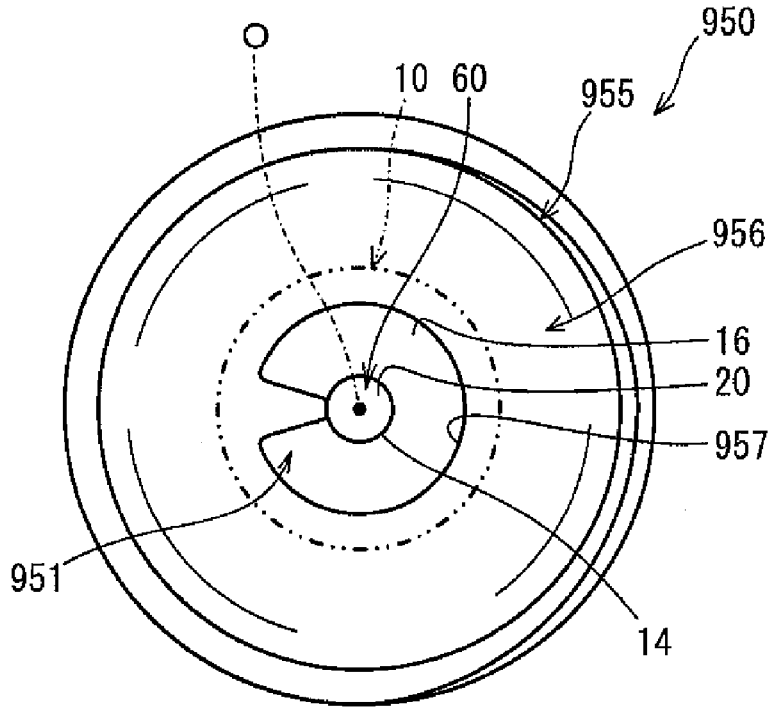
FIG. 24 is a view of a modified plasma jet ignition plug 950 as viewed from the front side with respect to the direction of the axis O.

The plasma jet ignition plug according to the second embodiment of the present invention can also be modified in various forms. For example, as in the case of a plasma jet ignition plug 950 shown in FIG. 24, the following configuration may be employed: a front end portion 956 of a metallic shell 955 is extended and bent radially inward, and a front end face 907 of the bent front end portion 956 is provided with a ground electrode 951 which, as in the case of the aforementioned plasma jet ignition plug 900 (see FIG. 22), projects radially inward. That is, similar to the aforementioned plasma jet ignition plug 700, the projecting length of the ground electrode 951 can be shortened, so that the influence of load associated with its own weight can be reduced.

Figure 25:
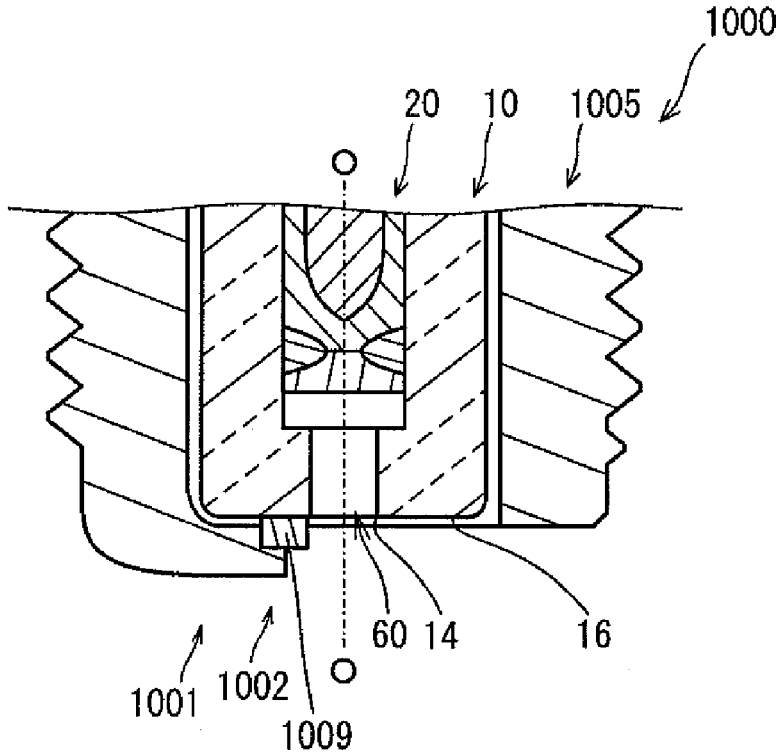
FIG. 25 is an enlarged sectional view of a front end portion of a modified plasma jet ignition plug 1000.

As in the case of a plasma jet ignition plug 1000 shown in FIG. 25, a noble metal chip 1009 similar to that of the aforementioned plasma jet ignition plug 650 (see FIG. 13) may be joined to a distal end 1002 of a ground electrode 1001 formed integral with a metallic shell 1005. This inhibits impeding radial expansion of plasma emitted from the cavity 60, whereby ignitability of the plasma jet ignition plug 1000 can be ensured. Furthermore, by means of joining the noble metal chip 1009 to the distal end 1002 of the ground electrode 1001 such that the position of joining is located on a side toward the cavity 60 (on a side facing the front end face 16 of the insulator 10), spark discharge is performed reliably via the noble metal chip 1009, and detachment of the noble metal chip 1009 can be prevented.

Figure 26:
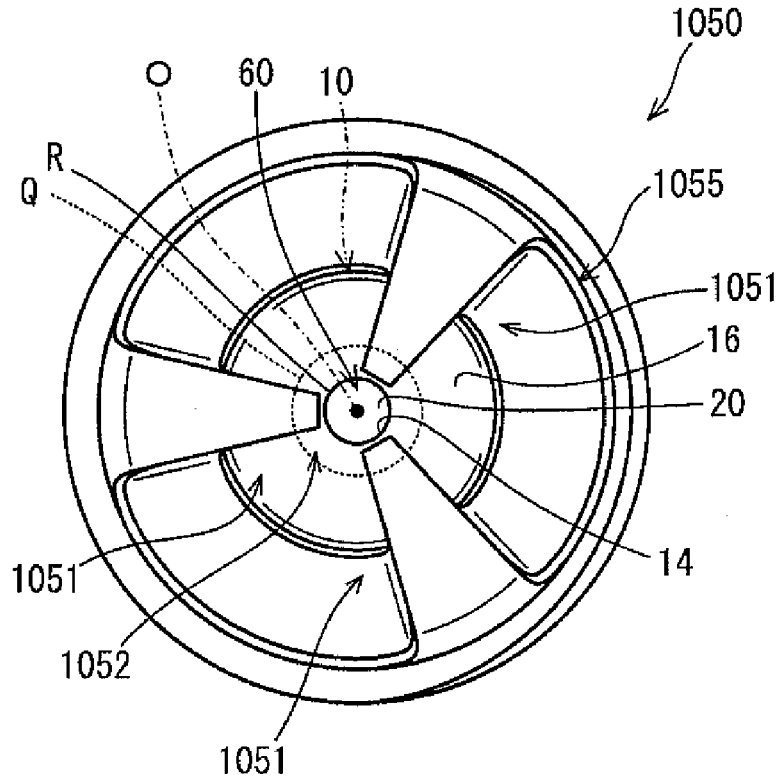
FIG. 26 is a view of a modified plasma jet ignition plug 1050 as viewed from the front side with respect to the direction of the axis O.

As in the case of a plasma jet ignition plug 1050 shown in FIG. 26, similar to the aforementioned plasma jet ignition plugs 500 (see FIG. 10) and 550 (see FIG. 11), a plurality of (three in this example) ground electrodes 1051 formed integral with a metallic shell 1055 may be provided. By virtue of this configuration, a plurality of spark discharge gaps can be formed in a dispersed fashion, and erosion of the opening end 14 caused by channeling can be inhibited. Needless to say, noble metal chips may be joined to respective distal ends 1052 of the ground electrodes 1051. Also, similar to the first embodiment, it may be sufficient that, as viewed on an imaginary plane which is orthogonal to the axis O and on which the ground electrodes 1051 are projected, the total projected area of portions of the ground electrodes 1051, the portions being disposed within the region lying between the imaginary boundary line Q and the outline R, is 30% or less of the area enclosed by the imaginary boundary line Q (15% or less of the area enclosed by the outline R of the opening end 14 when the portions are disposed within the outline R).

In order to confirm the effects yielded by disposing the distal end of the ground electrode of the plasma jet ignition plug in the vicinity of the opening end of the cavity and specifying the degree of areal occupation by the ground electrode on a side toward the front end of the insulator, the following evaluation tests were conducted.

EXAMPLE 1

First, an evaluation test was conducted to examine how the positional relation, with respect to a radial direction, between the distal end of the ground electrode and the opening end of the cavity relates to occurrence of channeling. In this evaluation test, ground electrodes were prepared by cutting a bar material of INCONEL 601 having a width of 0.5 mm into pieces each having a predetermined length. Six types of intermediate members, each consisting of a metallic shell and a ground electrode joined to the metallic shell, were prepared so as to attain the following variations in the distance along the diametral direction P between the distal end of the ground electrode and the opening end of the cavity (hereinafter, called the "distance G" for convenience) as viewed on an imaginary plane, such as the paper on which FIG. 3 appears, which is orthogonal to the axis O and on which the ground electrode is projected: the distance assumes values ranging from −0.1 mm to 0.5 mm. By use of the six types of intermediate members, six types of plasma jet ignition plug samples, three samples for each type, were prepared. In all of the samples, the distal end of the ground electrode was held in contact with the front end face of the insulator with respect to the direction of the axis O (i.e., the gap H (see FIG. 2) was set to 0 mm). In the insulators used for assembly of the samples, the opening end of the cavity had a diameter A (see FIG. 3) of 1.0 mm. As for the plus-minus sign for the distance Q the outside of the position (±0) of the opening end along the diametral direction P (the side away from the axis O) was taken as positive, whereas the inside of the position along the diametral direction P (the side toward the axis O) was taken as negative. That is, when the distance G assumes a negative value, it means that the distal end of the ground electrode is located inward of the opening end.

The samples were placed in a pressure chamber which was filled with nitrogen at a pressure of 0.4 MPa. The samples were subjected to 20-hour continuous discharge at a discharge frequency of 60 Hz in an amount of energy of 50 mJ. Subsequently, the samples were examined for the condition of a region in the vicinity of the opening end of the cavity. If even one of the three samples of a certain type exhibited the formation of a discharge groove deeper than 0.1 mm, the type was judged to have suffered channeling. If all three samples of a certain type exhibited a discharge groove depth of 0.1 mm or less, the type was judged to be free from channeling. The test results are shown in Table 1.

TABLE 1

| | | | | | | |
|---|---|---|---|---|---|---|
| Distance G [mm] between distal end of ground electrode and opening end of cavity | −0.1 | 0 | 0.1 | 0.2 | 0.3 | 0.5 |
| Gap H [mm] between distal end of ground electrode and insulator | | | | 0 | | |
| Occurrence of channeling | No | No | No | No | Yes | Yes |

As shown in Table 1, in the case where the gap H is 0 mm; i.e., the distal end of the ground electrode is in contact with the front end face of the insulator, the samples having a distance C of 0.2 mm or less are free from channeling, whereas the samples having a distance G in excess of 0.2 mm suffer channeling.

EXAMPLE 2

Six types of plasma jet ignition plug samples having the distal end of the ground electrode apart from the front end face of the insulator with a gap H of 0.1 mm were prepared while the distance G assumed values ranging from −0.1 mm to 1.0 mm. Dimensions of other portions of the samples were the same as those of Example 1. The samples were subjected to the same evaluation test as that of Example 1 and were evaluated for occurrence of channeling. The test results are shown in Table 2. Next, six types of samples having a gap H of 0.5 mm as measured along the direction of the axis O between the distal end of the ground electrode and the front end face of the insulator were prepared while other features were similar to those of the above-mentioned samples. These samples were also subjected to the same evaluation test. The test results are shown in Table 3.

TABLE 2

| | | | | | | |
|---|---|---|---|---|---|---|
| Distance G [mm] between distal end of ground electrode and opening end of cavity | −0.1 | 0 | 0.3 | 0.5 | 0.7 | 1.0 |
| Gap H [mm] between distal end of ground electrode and insulator | | | | 0.1 | | |
| Occurrence of channeling | No | No | No | No | Yes | Yes |

TABLE 3

| | | | | | | |
|---|---|---|---|---|---|---|
| Distance G [mm] between distal end of ground electrode and opening end of cavity | −0.1 | 0 | 0.3 | 0.5 | 0.7 | 1.0 |
| Gap H [mm] between distal end of ground electrode and insulator | | | | 0.5 | | |
| Occurrence of channeling | No | No | No | No | Yes | Yes |

As shown in Table 2, in the case where the gap H is 0.1 mm, the samples having a distance G of 0.5 mm or less are free from channeling, whereas the samples having a distance G in excess of 0.5 mm suffer channeling. Also, as shown in Table 3, in the case where the gap H is 0.5 mm, a similar tendency is observed. That is, the samples having a distance G of 0.5 mm or less are free from channeling, whereas the samples having a distance G in excess of 0.5 mm suffer channeling. The results of the evaluation tests have revealed that, irrespective of the gap H along the direction of the axis O between the distal end of the ground electrode and the front end face of the insulator; when the distance G along the diametral direction P between the distal end of the ground electrode and the opening end of the cavity is in excess of 0.5 mm, occurrence of channeling cannot be inhibited. The test results of Examples 1 and 2 have revealed that occurrence of channeling can be inhibited by employing a distance G of 0.5 mm or less in the case where the distal end of the ground electrode is disposed apart from the front end face of the insulator (H>0 [mm]), and a distance G of 0.2 mm or less in the case where the distal end is disposed in contact with the front end face (H=0 [mm]).

EXAMPLE 3

Next, an evaluation test was conducted to examine, as viewed on an imaginary plane which is orthogonal to the axis O and on which the ground electrode 30 is projected, the influence of the percentage of the projected area of the portion S (see FIG. 3) of the ground electrode 30 disposed within a region lying between the imaginary boundary line Q and the outline R to the area enclosed by the imaginary line Q. For this evaluation test, seven types of plasma jet ignition plug samples were prepared while, as viewed on the imaginary plane (the paper on which FIG. 3 appears) orthogonal to the axis O, the diameter A of the opening end of the cavity, the width of the ground electrode, and the distance G between the distal end of the ground electrode and the opening end were varied as appropriate. Through the dimensional variations, the projected area of the portion S (see FIG. 3) of the ground electrode disposed within the region lying between the imaginary boundary line Q having the diameter 2A, which is two times the diameter A of the opening end, and the outline R of the opening end was varied as appropriate within a range of 14.6% to 37.4% of the area enclosed by the imaginary boundary line Q.

Each of the samples was attached to the pressure chamber and checked for ignitability. Specifically, after attachment of each of the samples, the chamber was filled with a mixture of air and C3H8 gas with a mixing ratio (air-fuel ratio) of 22 at a pressure of 0.05 MPa. The sample was connected to a power source capable of supplying energy in an amount of 50 mJ, and a high voltage was applied to the sample for attempting ignition. The inner pressure of the chamber was measured by use of a pressure sensor to check for variation in the inner pressure of the chamber, whereby whether or not the air-fuel mixture was ignited was checked. A series of the operations was carried out 100 times, and the probability of ignition was calculated. The test results are shown in the graph of FIG. 27.

Figure 27:
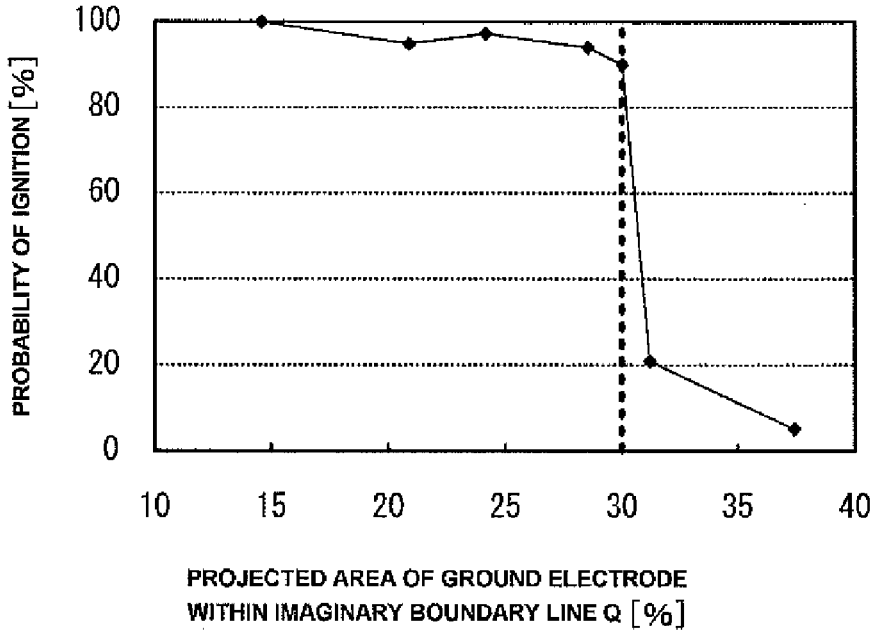
FIG. 27 is a graph showing the probability of ignition vs. the percentage of the projected area of the ground electrode projected within an imaginary boundary line Q.

As shown in FIG. 27, in the case where the projected area of the portion S of the ground electrode disposed within the region lying between the imaginary boundary line Q and the outline R was 14.6% of the area enclosed by the imaginary boundary line Q, the probability of ignition was 100%. Even when the projected area of the portion S rose to 20.9%, 24.1%, 28.5%, and 30.0%, the probabilities of ignition were 95%, 97%, 94%, and 90%, respectively; i.e., a high probability of ignition of 90% or more could be maintained. However, when the projected area of the portion S rose to 31.2%, the probability of ignition dropped greatly to 21%. When the projected area of the portion S was 37.4%, the probability of ignition dropped further to 5%. The graph has revealed that, when the projected area of the portion S of the ground electrode disposed within the region lying between the imaginary boundary line Q and the outline R is 30% or less of the area enclosed by the imaginary boundary line Q, a high probability of ignition of 90% or more can be obtained.

EXAMPLE 4

Similar to Example 3, an evaluation test was conducted to examine, as viewed on an imaginary plane which is orthogonal to the axis O and on which the ground electrode is projected, the influence of the percentage of the projected area of the portion T (see FIG. 5) of the ground electrode 251 disposed within the outline R to the area enclosed by the imaginary line R. In this evaluation test as well, similar to Example 3, seven types of plasma jet ignition plug samples were prepared while, as viewed on the imaginary plane (the paper on which FIG. 5 appears) orthogonal to the axis O, the diameter A of the opening end of the cavity, the width of the ground electrode, and the distance G between the distal end of the ground electrode and the opening end were varied as appropriate. Through the dimensional variations, the projected area of the portion T of the ground electrode disposed within the outline R of the opening end was varied as appropriate within a range of 5.0% to 25.2% of the area enclosed by the outline R. Each of the samples was attached to the pressure chamber. Similar to Example 3, the samples were subjected to the ignition test 100 times, and the probability of ignition was calculated. The test results are shown in the graph of FIG. 28.

Figure 28:
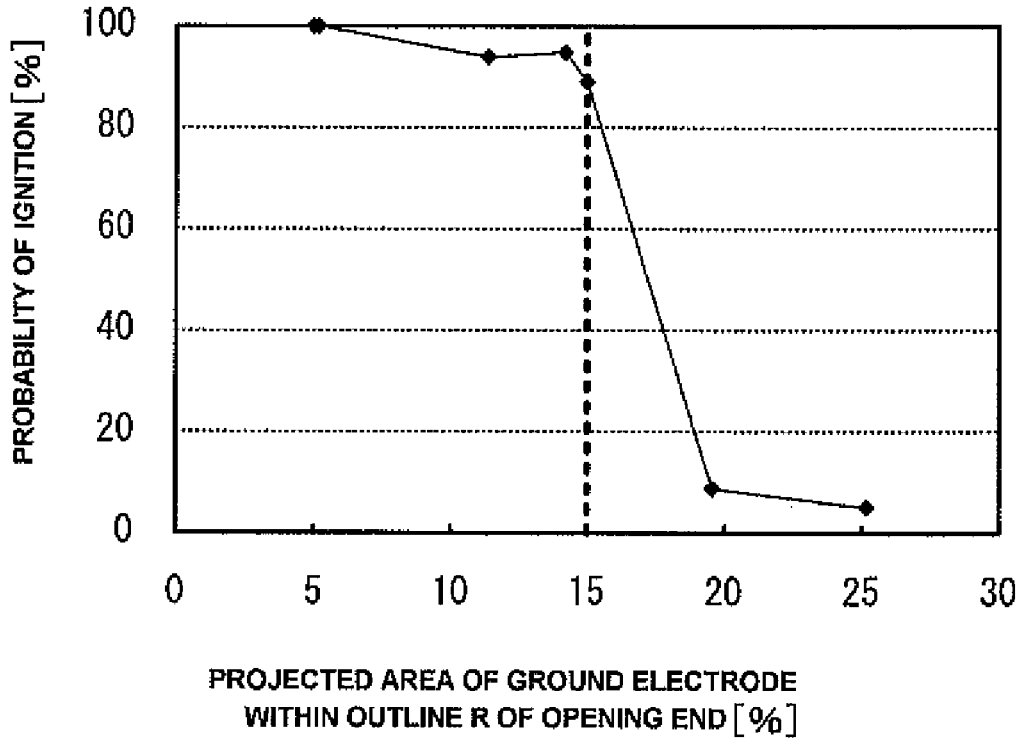
FIG. 28 is a graph showing the probability of ignition vs. the percentage of the projected area of the ground electrode projected within an outline R of an opening end.

As shown in FIG. 28, in the case where the projected area of the portion T of the ground electrode disposed within the outline R was 5.0% and 5.2% of the area enclosed by the outline R, the probability of ignition was 100%. Even when the projected area of the portion T rose to 11.4%, 14.2%, and 15.0%, the probabilities of ignition were 94%, 95%, and 89%, respectively; i.e., a high probability of ignition of 89% or more could be maintained. However, when the projected area of the portion T rose to 19.6%, the probability of ignition dropped greatly to 9%. When the projected area of the portion T was 25.2%, the probability of ignition dropped further to 5%. The graph has revealed that, when the projected area of the portion T of the ground electrode disposed within the outline R is 15% or less of the area enclosed by the outline R, a high probability of ignition of 89% or more can be obtained.

EXAMPLE 5

Next, an evaluation test was conducted to examine how the relation between the length w along the diametral direction P of the weld portion W of the ground electrode 30 and the length d along the diametral direction P of the extension portion D influences the joining strength between the ground electrode 30 and the metallic shell 50. First, six types of metallic shells of nominal size M12 were fabricated while their tubular-bore diameter was varied as appropriate within a range of 6.0 mm to 8.0 mm by means of varying the wall thickness of their front end portions. A wire of Pt-20Ir having a cross section of 1.0 mm×1.0 mm was cut into pieces each having a predetermined length to be described later, thereby forming ground electrodes. The ground electrodes were resistance-welded to the corresponding metallic shells. Then, insulators and other components were assembled to the metallic shells, thereby yielding six types of plasma jet ignition plugs.

The ground electrodes were joined to the respective metallic shells in the following manner: while the position of the distal end of the ground electrode was located at the position of the axis O, and the ground electrode was laid along the diametral direction P, a base end portion of the ground electrode was joined to the front end face of the metallic shell. By this procedure, the weld portion W associated with joining between the ground electrode and the metallic shell is formed at a portion of the ground electrode disposed on the front end face of the metallic shell. Thus, a portion of the ground electrode which projects radially inward from the front end face of the metallic shell corresponds to the extension portion D. Accordingly, the radius of the tubular bore of the metallic shell can be considered as the length d along the diametral direction P of the extension portion D. Furthermore, a length after the length d is subtracted from the length of a cut piece of the wire used in fabrication of the ground electrode can be considered as the length w of the weld portion W. Thus, in order to prepare the samples such that the ratio of the length w of the weld portion W to the entire length of the ground electrode (d+w); i.e., w/(d+w), is varied as appropriate within the range of 0.60 to 0.88, the cutting length of the wire was determined according to the six types of the metallic shells in fabrication of the ground electrodes. The length w of the weld portion W does not necessarily coincide with the wall thickness of a front end portion of the metallic shell. That is, as viewed on an imaginary plane which is orthogonal to the axis O and on which the ground electrode and the front end face of the metallic shell are projected, with respect to the diametral direction P, the position of the base end of the ground electrode and the position of the outer circumferential edge of the front end face of the metallic shell coincide with each other in some samples, and do not coincide with each other in other samples.

While the samples were heated at 200° C. by use of a burner, the samples were subjected for 30 minutes to an impact resistance test prescribed in JIS B8031. Subsequently, the cross sections of weld zones (not shown) formed by joining the ground electrodes and the metallic shells were visually observed for a crack or separation. If a certain sample exhibited even a slight separation or had a crack whose length was 50% or more than the entire length of the cross section, the sample was judged to have a crack or separation. If the length of a crack was less than 50% of the entire length of the cross section of the weld zone of a certain sample, the sample was judged to be free from a crack or separation. Table 4 shows the results of the evaluation test.

TABLE 4

| | | | | | | |
|---|---|---|---|---|---|---|
| d [mm] | 3.0 | 3.3 | 3.6 | 4.0 | 3.7 | 3.5 |
| w [mm] | 2.0 | 1.7 | 1.4 | 1.0 | 0.8 | 0.5 |
| d/(d + w) | 0.60 | 0.66 | 0.72 | 0.80 | 0.82 | 0.88 |
| Occurrence of crack or separation in weld zone | No | No | No | No | Yes | Yes |

As shown in Table 4, the four samples in which d/(d+w) was set to 0.80 or less were free of occurrence of a crack or separation, whereas the two samples in which d/(d+w) was set in excess of 0.80 exhibited occurrence of a crack or separation, indicating that load associated with its own weight of the ground electrode, together with load associated with heating, was imposed on the weld zone in the course of the impact resistance test resulting in the occurrence of a crack or separation. Thus, the test results have revealed that by means of mitigating load which is associated with its own weight of the ground electrode and is imposed on the weld zone, through employment of a d/(d+w) of 0.8 or less, occurrence of a crack or separation in the weld zone can be inhibited, whereby the joining strength between the ground electrode and the metallic shell can be enhanced.

The foregoing description discloses specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as disclosed herein, and as claimed or the equivalents thereof.

DESCRIPTION OF REFERENCE NUMERALS

10: insulator
12: axial bore
14: opening end
15: electrode-accommodating portion
16: front end face
20: center electrode
30, 901: ground electrode
31, 902: distal end
36: base end
50: metallic shell
60: cavity
61: front-end small-diameter portion
100, 900: plasma jet ignition plug Having described the invention, the following is claimed:

1. A plasma jet ignition plug comprising:
a center electrode;
an insulator retaining the center electrode;
a metallic shell surroundingly retaining the insulator;
a cavity formed in the form of a recess in a front end of the insulator and accommodating a front end of the center electrode therein; and
a ground electrode forming a spark discharge gap between the ground electrode and the center electrode via the cavity;
wherein the ground electrode is a bar-like member joined to the metallic shell, and
a distal end of the ground electrode is located radially inward of a position which is located 0.5 mm radially outward from an opening end of the cavity.

2. A plasma jet ignition plug according to claim 1, wherein a relation d/(d+w)≦0.8 is satisfied, where w is a length of a weld portion of the ground electrode extending along an extending direction of the ground electrode, the weld portion being formed through the ground electrode being joined to the metallic shell, and d is a length of a portion of the ground electrode extending from the weld portion toward the distal end.

3. A plasma jet ignition plug according to claim 1, wherein the distal end of the ground electrode is located radially inward of a position which is located 0.2 mm radially outward from the opening end of the cavity.

4. A plasma jet ignition plug according to claim 1, wherein the ground electrode is in contact with the front end of the insulator.

5. A plasma jet ignition plug according to claim 1, wherein the ground electrode projects in an inward direction.

6. A plasma jet ignition plug according to claim 1, wherein a plurality of the ground electrodes are provided.

7. A plasma jet ignition plug according to claim 1, wherein a noble metal chip is joined to the distal end of the ground electrode on a side toward the cavity.

8. A plasma jet ignition plug according to claim 1, wherein, as viewed on an imaginary plane which is orthogonal to an axial direction and on which the opening end of the cavity and the ground electrode are projected, a portion of the projected ground electrode which is located in an area enclosed by the imaginary boundary line which is concentric with an outline of the projected opening end and whose diameter is two times that of the outline, has a projected area which is 30% or less of an area enclosed by the imaginary boundary line.

9. A plasma jet ignition plug according to claim 8, wherein, as viewed on the imaginary plane, a portion of the projected ground electrode which is located inward of the outline of the projected opening end has a projected area which is 15% or less of an area enclosed by the outline of the projected opening end.

10. A plasma jet ignition plug comprising:

a center electrode;

an insulator retaining the center electrode;

a metallic shell surroundingly retaining the insulator;

a cavity formed in the form of a recess in a front end of the insulator and accommodating a front end of the center electrode therein; and a ground electrode forming a spark discharge gap between the ground electrode and the center electrode via the cavity;

wherein the ground electrode is a portion of the metallic shell and projects from a front end of the metallic shell, and a distal end of the ground electrode is located radially inward of a position which is located 0.5 mm radially outward from an opening end of the cavity.

11. A plasma jet ignition plug according to claim 10, wherein the distal end of the ground electrode is located radially inward of a position which is located 0.2 mm radially outward from the opening end of the cavity.

12. A plasma jet ignition plug according to claim 10, wherein the ground electrode is in contact with the front end of the insulator.

13. A plasma jet ignition plug according to claim 10, wherein the ground electrode projects in an inward direction.

14. A plasma jet ignition plug according to claim 10, wherein a plurality of the ground electrodes are provided.

15. A plasma jet ignition plug according to claim 10, wherein a noble metal chip is joined to the distal end of the ground electrode on a side toward the cavity.

16. A plasma jet ignition plug according to claim 10, wherein, as viewed on an imaginary plane which is orthogonal to an axial direction and on which the opening end of the cavity and the ground electrode are projected, a portion of the projected ground electrode which is located in an area enclosed by the imaginary boundary line which is concentric with an outline of the projected opening end and whose diameter is two times that of the outline, has a projected area which is 30% or less of an area enclosed by the imaginary boundary line.

17. A plasma jet ignition plug according to claim 16, wherein, as viewed on the imaginary plane, a portion of the projected ground electrode which is located inward of the outline of the projected opening end has a projected area which is 15% or less of an area enclosed by the outline of the projected opening end.

* * * * *